US007718246B2

(12) United States Patent
Strauss

(10) Patent No.: US 7,718,246 B2
(45) Date of Patent: May 18, 2010

(54) HONEYCOMB WITH A FRACTION OF SUBSTANTIALLY POROUS CELL WALLS

(76) Inventor: Ben Strauss, 293 Nassau St., Apt. 6, Princeton, NJ (US) 08540

( * ) Notice: Subject to any disclaimer, the term of this patent is extended or adjusted under 35 U.S.C. 154(b) by 0 days.

(21) Appl. No.: 11/766,569

(22) Filed: Jun. 21, 2007

(65) Prior Publication Data

US 2008/0044621 A1 Feb. 21, 2008

Related U.S. Application Data

(60) Provisional application No. 60/815,329, filed on Jun. 21, 2006.

(51) Int. Cl.
*B32B 3/12* (2006.01)
*B32B 3/26* (2006.01)

(52) U.S. Cl. ..... 428/118; 428/304.4; 428/311.11; 428/316.6; 428/318.6

(58) Field of Classification Search ..... 428/116, 428/117, 118, 119, 188, 913, 327, 73, 307.5, 428/34.5, 177, 304.4, 192; 501/118, 119, 501/120, 153, 154; 55/523, 585.3, 483, 502, 55/529; 264/177.12, 630; 52/302.1; 422/177; 156/89.11

See application file for complete search history.

(56) References Cited

U.S. PATENT DOCUMENTS 2,876,634 A 3/1959 Zimmerman et al.
3,070,198 A * 12/1962 Haskell ..... 428/116
3,148,676 A 9/1964 Truog et al.
3,463,140 A 8/1969 Rollor, Jr.
4,001,473 A * 1/1977 Cook ..... 428/116
4,126,178 A 11/1978 Kelm
4,329,162 A 5/1982 Pitcher, Jr.
4,379,191 A 4/1983 Beggs et al.
4,625,710 A * 12/1986 Harada et al. ..... 126/619
4,640,382 A 2/1987 Hartmann et al.
4,781,243 A 11/1988 DeVogel et al.
4,850,093 A 7/1989 Parente (Continued)

FOREIGN PATENT DOCUMENTS

EP 0 687 879 A1 12/1995

(Continued)

OTHER PUBLICATIONS

International Search Report for PCT/US2007/014481, mailed from the International Searching Authority on Nov. 22, 2007, 3 pgs.

(Continued)

*Primary Examiner*—David R Sample
*Assistant Examiner*—Nicole T Gugliotta
(74) *Attorney, Agent, or Firm*—Goodwin Procter LLP

(57) ABSTRACT

An artificial honeycomb structure, and simple constructions therefrom, are provided, wherein at least a portion of at least one of the enclosing honeycomb cell walls is substantially porous, open, or permeable, and wherein at least one of the hollow cells comprises at least one substantially nonporous enclosing wall. The honeycomb and its constructions can be useful in applications that include, but are not limited to, heat exchange and storage, structural support, impact absorption, filtration, acoustic dampening, catalysis, and flow control and distribution.

17 Claims, 15 Drawing Sheets

U.S. PATENT DOCUMENTS

| | | | | |
|---|---|---|---|---|
| 4,936,377 | A | | 6/1990 | DeVogel et al. |
| 5,089,062 | A | | 2/1992 | Pavlik et al. |
| 5,180,619 | A | | 1/1993 | Landi et al. |
| 5,271,244 | A | | 12/1993 | Staggs |
| 5,620,276 | A | | 4/1997 | Niemerski et al. |
| 5,840,400 | A | | 11/1998 | Landi et al. |
| 5,923,003 | A | * | 7/1999 | Arcas et al. ..... 181/292 |
| 6,003,283 | A | | 12/1999 | Hull |
| 6,039,832 | A | * | 3/2000 | McCarville ..... 156/292 |
| RE37,213 | E | | 6/2001 | Staggs |
| 6,273,186 | B1 | | 8/2001 | Ognibene |
| 6,287,436 | B1 | | 9/2001 | Pelletier et al. |
| 6,397,931 | B1 | | 6/2002 | Lancheo et al. |
| 6,634,417 | B1 | | 10/2003 | Kolowich et al. |
| 6,761,211 | B2 | | 7/2004 | Bhatti et al. |
| 6,840,307 | B2 | | 1/2005 | Eesley et al. |
| 6,881,703 | B2 | | 4/2005 | Cutler et al. |
| 2006/0092613 | A1 | | 10/2006 | Kao et al. |

FOREIGN PATENT DOCUMENTS

| | | |
|---|---|---|
| EP | 1 555 254 A1 | 7/2005 |

OTHER PUBLICATIONS

Written Opinion for PCT/US2007/014481, mailed from the International Searching Authority on Nov. 22, 2007, 4 pgs.

HexWeb® CRF Chromate free AGG® honeycomb, Jun. 2003 http://www.hexcel.com/NR/rdonlyres/760CBC24-869F-4564-AE55-3E11F963E326/0/HEXWEBCRF.pdf.

PAA-Core™ 5052, Aluminum Honeycomb http://www.mcgillcorp.com/alcore/datasheets/paa-core 5052si 0600.pdf.

Product Photo Album, http://www.machinetek.com/8.html.

Aktif® Perforated Honecomb, http://www.aktifdoga.com.tr/Aktif/EngAktifPetek.htm.

Maa "Microperforated-Panel Wideband Absorbers," Noise Control Engineering Journal 29(3):77-84, Nov.-Dec. 1987.

* cited by examiner

HONEYCOMB WITH A FRACTION OF SUBSTANTIALLY POROUS CELL WALLS

CROSS-REFERENCE TO RELATED APPLICATIONS

This application claims priority to and the benefit of U.S. provisional patent application Ser. No. 60/815,329 filed Jun. 21, 2006, the disclosure of which is being incorporated herein by reference in its entirety.

FIELD OF THE INVENTION

The present invention relates generally to the field of artificial honeycomb structures and more particularly to artificial honeycomb structures including both porous and nonporous wall portions.

BACKGROUND OF THE INVENTION

Artificial honeycomb structures are used in a wide range of applications, such as for structural support, impact absorption, filtration, acoustic dampening, chemical reaction catalysis, and heat storage and exchange. Through the present, honeycomb has been manufactured with either all substantially solid walls or all substantially porous walls, which has limited the performance and applicability of honeycomb type structures in a number of ways.

One important field in which the use of honeycomb has been restricted due to its limitations is heat exchange, with other articles more commonly employed today in thermal applications.

The use of structures and materials to promote and control the exchange of heat from one body to another is of great importance in a number of industries. Heat exchanging devices are of vital importance in numerous fields, ranging from the field of energy production, HVAC (Heat, Ventilation, and air conditioning), computing and other electronic devices, mechanical devices, and chemical processing, to the field of food preparation and storage.

For example, the increasing power demands and decreasing size of computing and electronic components and devices place a premium on compact and efficient thermal control systems. Regulation of temperature beneath critical thresholds can enhance the function and efficiency of, and prevent damage to, key electronic components.

Numerous means of controlling temperature have been utilized, including the use of honeycomb, fin arrays, pin fin arrays, metallic foams, and other structural elements, and the incorporation of different materials with various heat transfer properties. In electronic systems, air is generally used as the fluid medium into which heat exchangers dissipate excess heat. Because of the low thermal capacity of air, the movement of heat into air is commonly a rate-limiting step. It is well known that a high heat transfer area between exchanger and air is one of the most important means for mitigating this problem and achieving rapid heat dissipation. Metallic foams achieve high heat transfer areas in compact structures due to their high surface area to volume ratios, and have recently been proposed or adapted for use in numerous heat exchange applications, including in the field of electronics, as disclosed, for example, in U.S. Pat. Nos. 6,840,307 and 6,761,211. However, due to tortuosity effects, the effective thermal conductivity of foamed metal can commonly be under ten percent of that of the base material. Metallic foams have been combined with fins into composite heat exchangers to combat this problem, but the multiple components required for such structures may lead to difficulty and expense in manufacture, especially if the alternating components are densely packed in an attempt to optimize the balance of conduction and heat transfer area. Furthermore, metallic foams themselves may be expensive to manufacture.

More traditional structures, such as fin arrays and pin fin arrays, do not suffer from reduced effective thermal conductivity, due to the solid construction of fins and pins and the direct paths for heat conduction thus afforded. However, fin arrays and pin fin arrays typically achieve significantly lower surface area to volume ratios due to their relative simplicity of structure and the relatively thick fins generally required for inexpensive manufacture and structural integrity. Example fin embodiments are illustrated in U.S. Pat. Nos. 6,273,186 and 6,397,931, and U.S. Patent Application No. 2006/0092613 A1. While these devices and materials have been useful in providing a means of controlling the temperature of a given body or fluid, they have been of limited use in providing advantageous and inexpensive combinations of effective thermal conductivity away from a heat source, and overall surface area to volume ratio.

In addition, traditional honeycomb structures and vented honeycomb structures have been used for some heat exchange applications. However, as they do not allow significant transverse fluid flow through their cell walls they are not well-suited for continuous or high-performance heat exchange tasks. Porous honeycomb structures, such as the extruded and sintered integral honeycomb described in U.S. Pat. No. 6,881,703, may be more suitable, as they allow transverse flow. However, general methods of manufacturing porous honeycomb (such as sintering) can be very expensive, and have practically limited the manufacture of porous honeycomb to small blocks of integral honeycomb. The traditional methods of manufacture can also require a minimum wall thickness that is generally relatively thick, leading to relatively poor surface area to volume ratios. These methods can also produce very small and sinuous pores and result in high pressure drops in transverse flow. Furthermore, embodiments in which the entire honeycomb is porous-walled lack key advantages of solid walls, including structural strength and increased speed of heat conduction along cellular column axes.

Traditional honeycomb structures may also generally be very strong, and can therefore absorb a significant amount of mechanical energy. However, this traditional honeycomb often yields catastrophically once a sufficient pressure is applied. Honeycomb must, in certain cases, be pre-crushed for energy absorption applications where smooth absorption is important, which may be wasteful and imprecise. Traditional honeycomb can also provide an exceptionally high strength-to-weight ratio for structural applications. However, for applications where available honeycombs provide an excess of strength, weaker materials with lower weight may be desirable.

Porous honeycomb has been used in filtration applications (e.g. in U.S. Pat. No. 4,329,162), but pore size is generally uniform in existing porous honeycomb embodiments. As a result, porous honeycomb has not been used to enable progressive filtration of differently sized particles.

SUMMARY OF THE INVENTION

From the foregoing, there is a need for an easy and inexpensive way to manufacture large, structurally stable arrays of thin-walled fins, with the attendant advantages of high surface area to volume ratio together with high effective thermal conductivity, along with many further advantages that may not be specified here, while overcoming problems inherent in the use of traditional pin fin arrays, metallic foams, and porous walled honeycomb structures.

There is also a need for a honeycomb structure that can absorb impacts more smoothly, wherein the relationship between the strength and smoothness of the honeycomb can be manipulated into many different combinations through using different configurations. There is additionally a need for a honeycomb structure that is lighter weight than currently available configurations, even if at some expense to strength.

Further, there is a need for an at least partially porous honeycomb structure with controllably variable pore sizes, for purposes that can include, but may be not limited to filtration.

The present invention provides a new class of honeycomb and simple constructions therefrom, the honeycomb herein called hybrid honeycomb, wherein a fraction of cell walls are substantially porous, open, permeable, or comprise substantially porous portions, and the remaining walls are substantially nonporous, or solid. This structure includes structural, heat transfer, and further advantages of both solid walled and porous structures, as well as advantages not generally present in purely solid walled or purely porous honeycomb structures, which can include, but may be not limited to, the ability to channel fluid flow through multiple separate passageways in a plane or surface transverse to the honeycomb cell columns. Each face of a hollow cell is here defined as a wall, or enclosing wall, so that, for example, a hexagonal cell has six enclosing walls.

Several objects and further advantages of the present invention include, but are not limited to, providing a highly configurable component material for heat exchangers, heat sinks, heat storage devices, filtration devices, acoustic dampeners, catalytic substrates for chemical reactions, lightweight structural support elements, devices to absorb energy from impacts, flow controllers, flow distributors, and devices combining multiple functions including, but not limited to, the ones enumerated here.

One aspect of the invention can include a honeycomb structure including a plurality of contiguous hollow cells defined by a plurality of enclosing walls, wherein at least a portion of at least one of the plurality of enclosing walls is substantially porous, and wherein at least one of the hollow cells includes at least one substantially nonporous enclosing wall.

In one embodiment, the substantially porous wall portion is adapted to allow a fluid to flow therethrough. In one embodiment, at least one of the plurality of enclosing walls includes a material selected from the group consisting of a metal, a metal alloy, a ceramic, a fiberglass material, a graphite material, a paper material, a plastic, and a thermoforming plastic. The metal can be selected from the group consisting of aluminum, copper, stainless steel, titanium, brass, nickel, tin, zinc, iron, silver, gold, platinum, and combinations thereof.

In one embodiment, at least one of the enclosing walls can have a thickness of less than about 0.01 inches. In one embodiment, porosity of at least one of the porous wall portions is greater than about 25 percent. In one embodiment, the plurality of enclosing walls are adapted to allow fluid flow between at least two of the plurality of contiguous hollow cells. In one embodiment, the plurality of contiguous hollow cells can form a plurality of substantially independent flow channels. In one embodiment, at least one hollow cell includes a plurality of substantially nonporous walls to prevent fluid flow therethrough.

In one embodiment, the honeycomb structure can also include at least one cell group, wherein the cell group includes a plurality of hollow cells, and wherein the cell group is surrounded by substantially nonporous cell walls. In one embodiment, at least one interior wall portion of the cell group can be removed.

In one embodiment, a plurality of the enclosing walls are substantially nonporous, and a plurality of these are substantially parallel.

The honeycomb structure can also include a surface element, wherein the surface element is adapted to cover at least a portion of an outer surface of the honeycomb structure. The honeycomb structure can also include a sealing element adapted to seal at least a portion of the honeycomb structure. The honeycomb structure can also include a phase change material held within at least one of the plurality of contiguous hollow cells.

One aspect of the invention can include a honeycomb structure including a plurality of ribbons, wherein at least one of the ribbons includes at least one substantially porous portion, and wherein at least one of the ribbons includes at least one substantially nonporous portion. At least one of the plurality of ribbons can be corrugated. The plurality of ribbons can be connected at a plurality of discrete locations such that the plurality of ribbons form a plurality of honeycomb cells, and wherein at least one of the plurality of honeycomb cells includes at least one substantially porous cell wall portion. In one embodiment, the plurality of ribbons are bonded together along substantially parallel strips of each ribbon.

In one embodiment, at least one of the plurality of ribbons can include a material selected from the group consisting of a metal, a metal alloy, a ceramic, a fiberglass material, a graphite material, a paper material, a plastic, and a thermoforming plastic. The metal can be selected from the group consisting of aluminum, copper, stainless steel, titanium, brass, nickel, tin, zinc, iron, silver, gold, platinum, and combinations thereof.

In one embodiment, at least one of the ribbons can have a thickness of less than about 0.01 inches. The porosity of at least one porous portion can be greater than about 25 percent. The plurality of ribbons can be adapted to allow fluid flow between at least two of the plurality of honeycomb cells. In one embodiment, the plurality of honeycomb cells can form a plurality of substantially independent flow channels. In one embodiment, at least one honeycomb cell can include a plurality of substantially nonporous enclosing walls adapted to prevent fluid flow therethrough. In one embodiment, a plurality of the substantially nonporous enclosing walls are substantially parallel. In one embodiment, all of the ribbons are corrugated.

In one embodiment, the honeycomb structure can also include at least one cell group, wherein the cell group includes a plurality of hollow cells, and wherein the cell group can be surrounded by substantially nonporous cell walls. In one embodiment, at least one interior wall portion of the cell group can be removed. In one embodiment, the plurality of ribbons can include a single ribbon including a plurality of folds, wherein the single ribbon is adapted to be folded into a plurality of substantially abutting ribbon sections.

One aspect of the invention can include a method of manufacturing a honeycomb structure. The method can include the step of providing a plurality of ribbons, wherein at least one of the ribbons comprises at least one substantially porous portion, and wherein at least one of the ribbons comprises at least one substantially nonporous portion. The method can further include the steps of connecting the plurality of ribbons together at a plurality of discrete locations on opposite faces of each ribbon, thus forming a unitary assembly of bonded ribbons and expanding the assembly of bonded ribbons to form the honeycomb structure.

In one embodiment, the expanding step can require pulling outwardly along an axis substantially perpendicular to the elongate planes of the plurality of ribbons. In one embodiment, the plurality of ribbons are bonded together along substantially parallel strips of each ribbon. In one embodiment, at least one of the plurality of ribbons can include a material selected from the group consisting of a metal, a metal alloy, a ceramic, a fiberglass material, a graphite material, a paper material, a plastic, and a thermoforming plastic. The metal can be selected from the group consisting of aluminum, copper, stainless steel, titanium, brass, nickel, tin, zinc, iron, silver, gold, platinum, and combinations thereof. In one embodiment, the material can be a flexible material. In one embodiment, at least one of the ribbons can have a thickness of less than about 0.01 inches. In one embodiment, porosity of at least one porous portion is greater than about 25 percent.

In one embodiment, the honeycomb structure can include at least one cell group. The cell group can include a plurality of hollow cells, and the cell group can be surrounded by substantially nonporous cell walls. In one embodiment, the method can further include the step of removing at least one interior wall portion of the cell group.

In one embodiment, the plurality of ribbons can include a single ribbon comprising a plurality of folds. The method can further include the step of folding the single ribbon into a plurality of substantially abutting ribbon sections.

Another aspect of the invention can include a method of manufacturing a honeycomb structure. The method can include the steps of providing a plurality of ribbons, wherein at least one of the ribbons comprises at least one substantially porous portion, and wherein at least one of the ribbons comprises at least one substantially nonporous portion, corrugating at least one of the plurality of ribbons, and connecting the plurality of ribbons together at discrete locations such that the walls of the connected ribbons form the honeycomb structure.

In one embodiment, the at least one corrugated ribbon is connected to adjoining ribbons substantially at crests and troughs of the corrugations of the corrugated ribbon. In one embodiment, the plurality of ribbons are bonded together at the discrete locations.

In one embodiment, at least one of the plurality of ribbons can include a material selected from the group consisting of a metal, a metal alloy, a ceramic, a fiberglass material, a graphite material, a paper material, a plastic, and a thermoforming plastic. The metal can be selected from the group consisting of aluminum, copper, stainless steel, titanium, brass, nickel, tin, zinc, iron, silver, gold, platinum, and combinations thereof. In one embodiment, the material can include a flexible material. In one embodiment, at least one of the ribbons can have a thickness of less than about 0.01 inches. In one embodiment, porosity of at least one porous portion is greater than about 25 percent.

In one embodiment, the honeycomb structure can include at least one cell group. The cell group can include a plurality of hollow cells, and the cell group can be surrounded by substantially nonporous cell walls. In one embodiment, the method can further include the step of removing at least one interior wall portion of the cell group.

Another aspect of the invention can include an apparatus for use in heat exchange and storage. The apparatus can include a honeycomb structure and at least one face member connected to a side of said honeycomb structure such that the connecting surface of the at least one face member substantially conforms to the shape of the matching connecting surface of said honeycomb over the area of connection. The apparatus can further include a connection between said honeycomb structure and said face member, a seal, and a phase change material, wherein the phase change material can at least partially fill a sealed cavity that may be formed between said honeycomb structure and the at least one face member. The honeycomb structure can include a plurality of hollow cells including a plurality of enclosing walls, wherein at least a portion of at least one of the plurality of enclosing walls is substantially porous, and wherein at least one of the hollow cells comprises at least one substantially nonporous enclosing wall.

Another aspect of the invention can include a heat exchanger. The heat exchanger can include a honeycomb structure and at least one tubular structure connected to the honeycomb structure, wherein the honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

Yet another aspect of the invention can include a cross-flow heat exchanger. The cross-flow heat exchanger can include a honeycomb structure, at least one face member connected to at least one side of the honeycomb structure, at least one opening on the at least one face member, and at least one flange to seal at least a portion of the connection between the honeycomb structure and at least one face member. The fluid can be channeled though the at least one opening and through at least a portion of the honeycomb structure. The honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

Yet another aspect of the invention can include a cross-flow heat exchanger, including a honeycomb structure, at least one cell sealed at or near at least one of its ends, or within its interior, and at least one cell left open at both of its ends and within its interior. The honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

Yet another aspect of the invention can include a plate-fin or cross-flow or counter-flow heat exchanger. The heat exchanger can include at least one honeycomb structure and at least one conductive face member. The at least one conductive face member is interleaved and connected with the at least one honeycomb structure, such that each connecting surface of each face member substantially conforms to the shape of the matching connecting surface of the at least one adjacent honeycomb structure over the area of connection. The honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

Yet another aspect of the invention can include a device for use as a structural element and/or for mechanical energy absorption and/or for acoustic dampening and/or for heat exchange. The device can include at least one honeycomb structure and at least one face member. The at least one face member is interleaved with the at least one honeycomb structure, such that each connecting surface of each face member substantially conforms to the shape of the matching connecting surface of the at least one adjacent honeycomb structure over the area of connection. The honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

Yet another aspect of the invention can include a porous article including a honeycomb structure and an interconnectedly porous matrix at least partially filling the void space inside the honeycomb structure. The honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

Yet another aspect of the invention can include a method of manufacturing a porous article. The method can include the steps of providing a honeycomb structure and providing a powdered metal or alloy, which may or may not be mixed with one or more binders, liquids, foaming agents and/or nonmetallic particles, or coated on a polymeric foam, to form a slurry, paste, suspension, or coated foam. The method can further include the steps of at least partially filling the void space inside the honeycomb structure with the metallic powder or the slurry, paste, suspension, or coated foam, activating the foaming agent if present, and providing a means to bind the metallic powder such as by sintering, and additionally means to remove binders, liquids, polymers, foaming agents and/or nonmetallic particles if present. The honeycomb structure can include a plurality of hollow cells including a plurality of enclosing walls, wherein at least a portion of at least one of the plurality of enclosing walls is substantially porous, and wherein at least one of the hollow cells includes at least one substantially nonporous enclosing wall.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Figure 1:
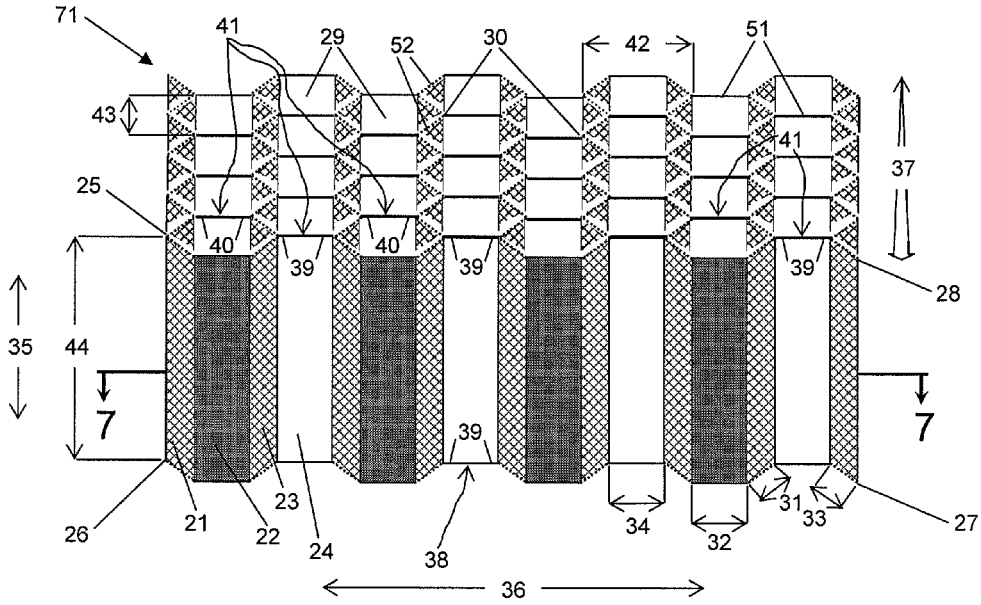
FIG. 1 shows a front perspective view of a small example or section of a preferred embodiment of hybrid honeycomb, in accordance with one embodiment of the invention.

A honeycomb structure of this invention can include at least two contiguous hollow cells including a plurality of enclosing walls, wherein at least part of at least one of the total number of enclosing walls is substantially porous and at least one is substantially nonporous, and wherein fluid can flow through the at least one porous wall portion. In many embodiments, substantially porous wall portions can comprise entire walls. Solid walls provide advantages that can include, but may be not limited to, strength, impermeability and an effective thermal conductivity equal or near equal to the conductivity of their constituent materials. Porous walls can provide advantages including, but not limited to, permeability to fluid flow, which may include one or more of air flow, water flow, or flow of other gaseous mixtures or liquids, or gases; a high surface area to volume ratio; filtration capability; acoustic dampening capability; relatively light weight per total volume (solid and void parts included); and smoother crushing performance than solid walls.

In various embodiments, the walls of the honeycomb can be made from any metal or metal alloy, including, but not limited to, aluminum, copper, stainless steel, titanium, brass, nickel, tin, zinc, iron, silver, gold, and platinum, or mixtures or alloys thereof, or from nonmetallic materials, including, but not limited to, aluminum-nitride ceramics, other ceramics, fiberglass, graphite, paper, thermoforming plastics, or other plastics. In heat exchange applications, materials with high thermal conductivity may be favored.

In one embodiment, all walls can be made from the same materials, while in another embodiment not all walls may be made from the same materials, allowing incorporation of a mixture of properties such as strength, density, thermal conductivity, and chemical attributes. The honeycomb walls can all share substantially the same thickness, or be of variable thickness. In one embodiment, the characteristic wall thickness can be less than 0.15 inches, in another, less than 0.01 inches, and in another embodiment can be as thin as 0.001 inches, or even thinner. One advantage of thin walls is a high surface area to volume ratio for rapid heat exchange, whereas one advantage of thick walls is strength; honeycombs with multiple wall thicknesses may combine these advantages.

Some or all walls can be formed of composites from two or more fused or bonded constituent layers. Some or all walls can be coated, laminated, or otherwise treated to modify properties which may include, but are not limited to, corrosion resistance, bonding performance and other chemical properties, and porosity.

In one embodiment, substantially porous walls may derive from the introduction of pores into formerly solid wall material by means including, but not limited to, perforation, chemical treatment, laser treatment, or slitting and expansion of the material. Alternatively, substantially porous walls may derive from an integral process that creates pores and wall simultaneously. This can be accomplished by sintering powdered metal extrusions or weaving fibers together into a mesh, felt, or screen, although other techniques may also be used.

In one embodiment, some or all substantially solid wall sections may derive from substantially porous wall, by means including, but not limited to, application of mechanical pressure, other forms of compression, addition of a sealant or sealing adhesive, addition of a substantially solid laminate layer, or heat treatment. Such methods would allow manufacture of hybrid honeycomb from wholly porous honeycomb.

In one embodiment, most or all wall pores, or openings, have a long axis and a short axis in the plane of the wall where they reside. The long axis of most or all pores can be oriented substantially parallel to the cellular column, or thickness, axis of the honeycomb, or, equivalently, can be oriented substantially perpendicularly to a transverse plane or surface. The long axis of most or all pores can alternatively be oriented substantially perpendicularly to the thickness axis of the honeycomb. In a further alternative embodiment, the long axis of most or all pores can be oriented at an oblique angle with respect to the thickness axis of the honeycomb. For a given porosity and pore pattern, orientation of pores may influence many factors, including among them wall strength and speed of heat conduction along different axes.

In various embodiments, within most or all substantially porous walls, most or all pores can be organized in a regular grid pattern, be organized in an alternating grid pattern, or be organized in a substantially random pattern. Pore pattern may be manipulated to influence many factors, including among them wall strength and speed of conductivity in different directions.

In one embodiment, the shortest length of passage through a number of, most, or all wall pores can be greater than the thickness of wall material defining the edges of each such pore in question, which may be the result of tortuosity of the pores within the wall material, or the result of a partially or substantially tubular orientation of wall material around the pores. Tortuous and tubular pores can increase the surface area of contact between the wall and a fluid flowing through the wall via its pores, which can be advantageous for heat exchange. Tubular pores can help to smooth and channel through-wall flow, potentially reducing turbulence, flow resistance, and pressure drop for transverse fluid flow in a honeycomb.

In one embodiment, the mean wall pore longest axis diameter in the plane of the wall can be greater than 0.1 micron. In other embodiments, the mean wall pore longest axis diameter in the plane of the wall can be greater than 10, 100, 500, or 1000 microns. In one embodiment, the porosity of most or all substantially porous walls can be greater than 25 percent, while in an alternative embodiment the porosity of most or all substantially porous walls can be greater than 50 percent. Relatively large pore sizes and porosity values may reduce flow resistance and pressure drop for transverse (i.e. cross-wall) fluid flow in a honeycomb. Relatively small pore sizes at a given porosity level increase the surface area of contact between fluid and wall, thus potentially enhancing heat transfer between the same.

In one embodiment, the mean or median size of pores on substantially porous cell walls changes in a generally monotonic fashion in one or more directions along a transverse plane or surface, whereby transverse flow can be progressively restrained or released, or suspended particles of different sizes can be progressively filtered.

In one embodiment of the invention, the honeycomb structure can include substantially porous and substantially solid walls that are arranged so that most or all constituent cells of the honeycomb can communicate with each other, and the honeycomb exterior, via fluid flow in a transverse plane or surface. The fluid flow can pass through the constituent cells via substantially porous cell walls. One advantage of a honeycomb block able to accommodate transverse fluid flow at or near the scale of the block as a whole may be to enhance the ability of the block to function as a component of a continuous capacity heat exchanger, since the flow could act to continuously supply heat to or remove heat from the honeycomb (which can additionally be receiving or transmitting heat by conduction with one or more attached members). In this and other embodiments, porous wall portions can be configured to allow through-flow with relatively little pressure drop—for example, by providing high degrees of porosity.

In one embodiment, most or all substantially solid cell walls of the honeycomb can be substantially parallel. One advantage of a parallel field of solid walls can be to channel fluid flow smoothly parallel to the orientation of the walls.

In one embodiment, at least one contiguous chain of substantially solid cell walls may partition the honeycomb structure into two or more areas or channels, such that the areas or channels may not substantially communicate with each other via transverse fluid flow within the honeycomb. One advantage of this arrangement may be the ability to accommodate flows of at least two different fluids without their mixing. In one elaboration of this embodiment, the channels can be substantially straight, while in an alternative embodiment the channels can be largely sinuous. Straight designs may reduce pressure drop of transverse flow across a honeycomb block, whereas sinuous designs can enhance turbulence and path length, and thereby heat exchange between a fluid and channel walls. In one embodiment, the width of the channels may be largely less than two cell widths, while in another embodiment the width of the channels may be largely equal to or greater than two cell widths. The centerlines of the channels can generally meet substantially porous cell walls at a substantially oblique angle. Alternatively, the centerlines of the channels can generally meet substantially porous cell walls at a substantially perpendicular angle. Channel width and angle of incidence at porous cell walls can be varied to influence flow resistance, among other factors.

In a further related embodiment, the width of individual channels can vary between relatively wide and relatively narrow sections, whereby resistance to, and speed of, fluid flow can be varied in different sections. In a heat sink application, for example, it may be advantageous to create rapid flow in the vicinity of a heat source, and low flow resistance downstream from the source, such as might be accomplished by a bowtie-shaped channel design where the narrow section of the bowtie corresponds with the heat source location.

In one embodiment of the invention, one or more cells or cell groups can be fully surrounded by substantially solid cell walls, whereby the cells or blocs substantially cannot communicate with other portions of the honeycomb or its exterior via transverse fluid flow. Thus, different fluids can occupy or flow through the isolated cells or blocs along the honeycomb thickness axis without mixing with any fluid occupying or flowing through any other parts of the honeycomb. Furthermore, cells or areas surrounded wholly by solid walls provide increased structural strength.

In one embodiment, one or more cells can be fully defined by substantially porous walls.

In one embodiment, the cells of the honeycomb structure can be of any shape or combination of shapes that can tessellate to fill a plane. In one embodiment, the distances from each node to its neighbors (i.e. those nodes reachable by moving along cell walls from the focal node without traversing any intervening nodes) are generally not all equal. A node is where walls meet. Alternatively, the distances from each node to its neighbors can all be equal. In one embodiment the angles formed by the walls radiating from each node are generally not all equal, while in another embodiment the angles formed by the walls radiating from each node can all be equal. Cell shape may influence the area of contact between fluid and honeycomb wall, structural strength of honeycomb, transverse and cell column-wise flow patterns and characteristics, and many other factors.

In one embodiment, each open face of the honeycomb substantially defines a transverse plane perpendicular to the substantially parallel cellular columns. In another embodiment, each open face of the honeycomb defines a curved transverse surface substantially perpendicular at each cell opening to the column axis of that cell. In this embodiment, cellular columns are not all substantially parallel. One advantage of curved honeycomb is that it can be fitted more smoothly to curved surfaces.

Many further possible embodiments combine the diverse embodiments so far considered in various combinations.

One aspect of the invention includes a honeycomb prepared by a method including the steps of providing at least two flat ribbons, one or more of which can be substantially porous at least in part, and one or more of which can be substantially solid at least in part, fusing or bonding the ribbons together in a stack along substantially parallel strips at a plurality of discrete locations on opposite faces of each ribbon (excepting the outermost ribbons, which can be fused and bonded on only their inward facing side), and expanding the stack of partially attached ribbons by pulling it outwardly along an axis substantially perpendicular to the planes of the ribbons. In one embodiment, a plurality of ribbons can be defined as and consist of a single ribbon folded back on itself a plurality of times.

In one embodiment of the invention, ribbons can be comprised of a ductile, flexible, or foldable substance, including, but not limited to, aluminum, copper, stainless steel, titanium, brass, nickel, tin, zinc, silver, gold, platinum, or alloys or mixtures thereof, or paper or plastic.

The different ribbons can be comprised of the same substance, or of different substances. The ribbons can share substantially the same thickness, or be of different thicknesses. In various embodiments, ribbon thickness may be less than 0.15 inches, 0.01 inches, 0.001 inches, 0.0001 inches, or thinner (for example, metallic foils at least as thin as 0.00006 inches are available from Hamilton Precision Metals). Some or all ribbons can be compositely formed from two or more fused or bonded constituent layers. Some or all ribbons can be coated, laminated, or otherwise treated to modify properties which may include, but are not limited to, corrosion resistance, bonding performance and other chemical properties, and porosity.

In one embodiment, the substantially porous ribbon sections or wholes can be manufactured by the introduction of pores into substantially solid ribbon by methods including, but not limited to, perforation, chemical treatment, laser treatment, or slitting and expansion, wherein slitting and expansion may be followed by flattening, whereby porous ribbon can be shaped to retain the same thickness as the original ribbon. Alternatively, substantially porous ribbon sections or wholes can be manufactured by methods that create both wall and void space simultaneously, including, but not limited to, sintering powdered metal or weaving fibers together into a mesh, felt, or screen.

In one embodiment, substantially solid ribbon sections or wholes can be manufactured by the conversion of substantially porous regions by methods including, but not limited to, application of mechanical pressure, other forms of compression, addition of a sealant or sealing adhesive, addition of a substantially solid laminate layer, or brazing, soldering, sintering, or other heat treatment.

In one embodiment, most or all ribbon pores, or openings, have a long axis and a short axis in the plane of the ribbon where they reside. The long axis of most or all pores can be oriented substantially parallel to the height axis of the ribbon (which will become the cellular column, or thickness, axis of the honeycomb), or, alternatively, substantially perpendicular or oblique to the height axis of the ribbon.

In various embodiments, within most or all substantially porous ribbon sections, most or all pores can be organized in a regular grid pattern, be organized in an alternating grid pattern, or be organized in a substantially random pattern. In one embodiment, the shortest length of passage through each of most or all ribbon pores can be greater than the thickness of ribbon material defining the edges of each such pore in question, which fact may be the result of tortuosity of pores within ribbon material, or the result of a partially or substantially tubular orientation of ribbon material around pores.

In one embodiment, the mean ribbon pore longest axis diameter in the plane of the ribbon can be greater than 0.1 micron. In other embodiments, the mean ribbon pore longest axis diameter in the plane of the ribbon can be greater than 10, 100, 500 or 1000 microns. In one embodiment, the porosity of most or all substantially porous ribbon sections can be greater than 25 percent, while in an alternative embodiment the porosity of most or all substantially porous ribbon sections can be greater than 50 percent.

In one embodiment, the mean or median size of pores on ribbons changes in a generally monotonic fashion throughout an ordered stack of ribbons set for expansion or already expanded into honeycomb. In another embodiment, the mean or median size of pores can change in a generally monotonic fashion from one end of a ribbon to the other along the width or length axis (the axis perpendicular to the axis for the strips along which separate ribbons are bonded together). According to either or both of these embodiments, in the assembled and expanded honeycomb, transverse fluid flow may be progressively restrained or released, or suspended particles of different sizes may be progressively filtered.

In one embodiment, the substantially porous ribbon regions can be arranged in strips parallel to the direction of the parallel strips for bonding or fusion, such that each substantially porous strip will form one or more cell walls in the expanded honeycomb. Strips for bonding or fusion are called junction strips herein, whereas the remaining strips on a ribbon are called free strips. In most or all fused or bonded pairs of junction strips, at least one junction strip can be substantially solid, or, in an alternative embodiment, can be substantially porous. Most or all free strips can be substantially porous, or this may be true for only a fraction of the total number of ribbons, or for none at all. A plurality of ribbons can be substantially solid or porous in full.

In one embodiment, at least one adjacent ribbon pair can possess at least one matched free and junction strip sequence wherein all free and junction strips between two junctions connecting the ribbon pair can be substantially solid. In another embodiment, at least one adjacent ribbon pair can possess at least one matched free and junction strip sequence wherein all free and junction strips between two junctions connecting the ribbon pair can be substantially porous. In a third embodiment, at least one adjacent ribbon pair can possess at least one matched free and junction strip sequence wherein at least one free or junction strip between two junctions connecting the ribbon pair can be substantially porous, and at least one can be substantially solid.

Ribbons can be stacked such that two or more ribbon types define a repeating layered pattern, the ribbon types defined by the placement and ordering of substantially porous and substantially solid strips, the strips further defined by their identities as active junction strips, passive junction strips, or free strips (active and passive junction strips are defined in the detailed description below).

Junction strips can be bonded or fused by methods which may include, but are not limited to, soldering, brazing, welding, sintering, and use of chemical adhesives. Junction strips can be fused or bonded substantially throughout their entire area of contact, or they can be fused or bonded only in an area lesser than their entire area of substantial contact, whereby the appearance and essential functionality of full fusion or bonding can be maintained despite a lesser use of adhesive, solder, heat, or other connecting means than would be required were strips fused or bonded substantially throughout their entire area of contact.

Most or all junction strips and/or free strips on most or all ribbons can be of substantially equal width. Most or all junction strips in stackingly matched positions on different ribbons can be of substantially equal width, whereby junction strip widths within each ribbon may or may not vary. Most or all free strips within a ribbon can be of substantially equal width, whereby free strip widths across different ribbons may or may not vary. Variation in free strip widths across ribbons can be accommodated while maintaining junction strips in stackingly matched positions before and after expansion through variation in free strip stretching or by pre-folding wide free strips prior to matching ribbons.

In various embodiments, the stack of ribbons can be expanded to a degree such that most or all angles of contiguous free strips with each other can be substantially 120 degrees, greater than 120 degrees, or less than 120 degrees. In a further embodiment, the stack of ribbons can be expanded to a degree such that most or all angles of contiguous free strips with each other can be substantially 180 degrees.

In one embodiment, the stack of ribbons can be curved following expansion such that each open face of the honeycomb so constructed defines a curved transverse surface substantially perpendicular at each cell opening to the column axis of that cell. In this embodiment, cellular columns are not all substantially parallel.

Many further possible embodiments combine the diverse embodiments of this aspect of the invention, in various combinations.

A further aspect of the invention includes a honeycomb prepared by a method including providing a plurality of flat ribbons, one or more of which can be substantially porous in part or in full, and one or more of which can be substantially solid in part or in full. The ribbons can then be fused or bonded together in a stack along substantially parallel strips in alternating locations on opposite faces of a plurality of ribbons, and in matching locations on opposite faces of the remainder of ribbons, excepting the outermost ribbons, which can be fused and bonded on only their inward facing sides. The stack of partially attached ribbons can then be expanded by pulling it outwardly along an axis substantially perpendicular to the planes of the ribbons. In one embodiment, a plurality of ribbons can be defined as and consist of a single ribbon folded back on itself a plurality of times.

Embodiments contemplated in the previously described aspect of the invention may also be contemplated in this one. For example, as contemplated above, various embodiments may differ in ribbon composition, thickness, coating, lamination, or other treatment; in methods for creating porous or solid ribbon sections; in pore diameter, thickness, orientation, and patterning; in porosity; in spatial patterns of pore size change (if any) within and across ribbons; in the patterning of porous and solid free and junction strips within and among ribbons; in the manner of junction strip fusion or bonding; in the widths of junction and free strips; in the degree of ribbon stack expansion; or in various combinations of these factors.

In another aspect of the invention, a honeycomb can be prepared by providing at least two flat ribbons, one or more of which can be substantially porous at least in part, and one or more of which can be substantially solid at least in part, corrugating the ribbons, and fusing or bonding the corrugated ribbons together at discrete locations, wherein adjoining ribbons can be bonded substantially at crest-to-trough of their corrugations, or in any other manner preserving open space between adjacent ribbons. In one embodiment, all corrugations can be substantially parallel. Alternatively, the honeycomb can include corrugations in some layers orthogonal to the corrugations of other layers, including a pattern wherein the orientation of corrugations alternates with each layer. In one embodiment, a plurality of ribbons or corrugated ribbons can be defined as and consist of a single ribbon or corrugated ribbon folded back on itself a plurality of times. In one embodiment, the entire ribbon may be corrugated. In an alternative embodiment, only certain folded sections of the ribbon need be corrugated, such as in an embodiment wherein alternating sections of the ribbon are corrugated with flat sections of ribbon in-between.

Embodiments contemplated in the previously described aspects of the invention may also be contemplated in this one. For example, as contemplated above, various embodiments may differ in ribbon composition, thickness, coating, lamination, or other treatment; in methods for creating porous or solid ribbon sections; in pore diameter, thickness, orientation, and patterning; in porosity; in spatial patterns of pore size change (if any) within and across ribbons; in the patterning of porous and solid free and junction strips within and among ribbons; in the manner of junction strip fusion or bonding; in the widths of junction and free strips; or in various combinations of these factors.

Another aspect of the invention includes a honeycomb prepared by a method including providing at least two flat ribbons, one or more of which can be substantially porous at least in part, and one or more of which can be substantially solid at least in part, corrugating at least one of the flat ribbons, but not all, and then fusing or bonding the corrugated and flat ribbons together at discrete locations such that the walls of the corrugated and flat ribbons form a substantially honeycombed structure. The flat ribbons can connect to adjoining corrugated ribbons along crests or troughs of the corrugation. The corrugated ribbons can connect to adjoining corrugated ribbons, should such pairings exist, in any manner preserving open space between them—for example, by substantially pairing corrugation crests to troughs across adjacent pairs. The flat ribbons can be connected to adjoining flat ribbons, should such pairings exist, in any fashion. In one embodiment, a single flat ribbon can be partially corrugated and then folded back on itself a plurality of times, and the folds collectively can be defined as and considered a plurality of flat and corrugated ribbons.

In one embodiment, all the corrugations can be substantially parallel. Alternatively, corrugations in some layers can be orthogonal to the corrugations of other layers, including a pattern wherein the orientation of corrugations alternates with each corrugated layer. In certain embodiments, flat and corrugated ribbons can alternate.

Various embodiments of this aspect may differ in ribbon composition, thickness, coating, lamination, or other treatment; in methods for creating porous or solid ribbon sections; in pore diameter, thickness, orientation, and patterning; in porosity; in spatial patterns of pore size change (if any) within and across ribbons; in the patterning of porous and solid free and junction strips within and among ribbons; in the manner of junction strip fusion or bonding; in the widths of junction and free strips; or in various combinations of these factors.

One aspect of the invention includes a honeycomb in which, during assembly, constituent corrugated ribbons or corrugated and flat ribbons can be molded onto a curved surface, including, but not limited to, a cylindrical mold, or otherwise guided into a curved shape, and fused or bonded to form a curved honeycomb structure, including, but not limited to, an annulus. Various embodiments of this aspect may differ in ribbon composition, thickness, coating, lamination, or other treatment; in methods for creating porous or solid ribbon sections; in pore diameter, thickness, orientation, and patterning; in porosity; in spatial patterns of pore size change (if any) within and across ribbons; in the patterning of porous and solid free and junction strips within and among ribbons; in the manner of junction strip fusion or bonding; in the widths of junction and free strips; or in various combinations of these factors. In certain embodiments, a single partly or wholly corrugated ribbon can be wrapped in a spiral around a cylinder or other closed, curved shape, and fused or bonded to itself to form a curved honeycomb structure.

Another aspect of the invention can include an apparatus for purposes that can include, but are not limited to, heat exchange and storage. This apparatus can include a honeycomb core, such as any of the honeycomb core embodiments described herein, and a face member connected to one open-cell side of the honeycomb core such that the connecting surface of the face member can substantially conform to or parallel the shape of the matching connecting surface of the honeycomb over the area of connection. In this apparatus, the honeycomb core can be connected to the face member using methods including, but not limited to, soldering, brazing, welding, sintering, use of chemical adhesives, or physical clamping of the core and member together under static pressure. In the apparatus, the honeycomb core can be sealed within a closed chamber in which the face member comprises one side using methods including, but not limited to, the connecting of a second face member to the opposite side of the honeycomb core and the addition of walls connected to and sealing with the two face members. A phase change material can at least partially fill the sealed cavity thereby created, comprised of the void space inside the honeycomb core and any additional void area between the core and the sealing members. Alternatively or in addition, one or more sealed cavities can be created by face members connected to the open-cell sides of the honeycomb core, together with substantially solid walls within the honeycomb, and a phase change material can at least partially fill the at least one sealed cavity thus formed.

Yet another aspect of the invention can include a device for purposes that can include, but are not limited to, heat exchange. The device can include a honeycomb core, such as any of the honeycomb core embodiments described herein, and a face member connected to one open-cell side of the honeycomb core such that the connecting surface of the face member can substantially conform to or parallel the shape of the matching connecting surface of the honeycomb over the area of connection. In the device, the honeycomb core can be connected to the face member or members using methods including, but not limited to, soldering, brazing, welding, sintering, use of chemical adhesives, or physical clamping of the core and member or members together under static pressure.

One aspect of the invention can include a device for purposes that can include, but are not limited to, heat exchange. The device can include a honeycomb core, such as any of the honeycomb core embodiments described herein, and one or more pipes or tubes running alongside one or more edges of the honeycomb, or through cellular columns or holes or indentations cut through the honeycomb. In the device, the honeycomb core can be connected to the pipes or tubes using methods including, but not limited to, soldering, brazing, welding, sintering, use of chemical adhesives, or physical clamping of the core and member or members together under static pressure.

One aspect of the invention can include a device for purposes that can include, but are not limited to, cross-flow heat exchange. This device can include a honeycomb core, such as any of the honeycomb core embodiments described herein, and face members connected to each side of the honeycomb core such that the connecting surfaces of the face members can substantially conform to or parallel the shape of the matching connecting surface of the honeycomb over the area of connection. The device can also include openings on opposite face members aligning with one or more cross-flow through-ways, a name for cells or cell groups enclosed by substantially solid walls within the honeycomb, thereby permitting fluid flow through one opening, through a through-way, and then out the opposite opening. Flanges to seal through-way walls with face members, thereby preventing leakage of fluid in through-ways into other portions of honeycomb, can also be included. In the device, fluid flow can be channeled through the openings and the through-ways, in a direction parallel to the cellular columns of the honeycomb core; separate flows can be channeled through the remainder of the honeycomb core in a transverse plane or surface direction. In an alternative embodiment, the device can include a honeycomb core, such as any of the honeycomb core embodiments described herein, and sealing members on both ends of each cell except for through-way cells, which remain open at both ends.

One aspect of the invention can include a plate-fin heat or cross-flow exchanger. This heat exchanger can include one or more conductive face members interleaved in alternating pattern with one or more honeycomb cores, such as any of the honeycomb core embodiments described herein. Each member can substantially conform to or parallel a transverse plane or curved surface of its one or two adjoining honeycomb cores, and either two members or two cores or one of each can comprise the outer components of a stack formed by their interleaving, the stack being comprised of at least one face member and at least one honeycomb core layers. In the heat exchanger, the honeycomb cores can be connected to the face members using methods including, but not limited to, soldering, brazing, welding, sintering, use of chemical adhesives, or physical clamping of the core and member or members together under static pressure.

A further aspect of the invention can include a device for purposes that can include, but are not limited to, structural support, impact energy absorption, acoustic dampening, and heat exchange. This device can include at least one honeycomb core, such as any of the honeycomb core embodiments described herein, and at least one face member interleaved with the at least one honeycomb core such that the connecting surface or surfaces of the at least one face member can substantially conform to or parallel the shape of the matching connecting surface of the honeycomb over the area of connection. The at least one honeycomb core can be connected to the at least one face member using methods including, but not limited to, soldering, brazing, welding, sintering, use of chemical adhesives, or physical clamping of the core and member together under static pressure.

Yet another aspect of the invention can include a device for purposes that can include, but are not limited to, filtration. This device can include a honeycomb core, such as any of the honeycomb core embodiments described herein, and one or more face members connected to each side of the honeycomb core. The connecting surface or surfaces of the face members can substantially conform to or parallel the shape of the matching connecting surface of the honeycomb over the area of connection. In the device, the honeycomb core can be connected to the face members using methods including, but not limited to, soldering, brazing, welding, sintering, use of chemical adhesives, or physical clamping of the core and member or members together under static pressure. One or more side members can connect the face members on one set of opposing sides so as to form a frame around the honeycomb core, such that fluid can flow perpendicular to the plane defined by the frame and through the frame and the honeycomb core that it encloses, flowing transversely through substantially porous wall sections in the honeycomb core. In the device, the side members can be connected with the face members using techniques including, but not limited to, soldering, brazing, welding, sintering, use of chemical adhesives, or physical clamping of the core and member or members together under static pressure.

One aspect of the invention can include a porous article for purposes that can include, but are not limited to, heat exchange. This device can include a honeycomb core, such as any of the honeycomb core embodiments described herein, and an interconnectedly porous matrix (meaning that pores communicate with each other and the matrix exterior) at least partially filling the void space in the honeycomb core. The matrix may be in strong thermal contact with the honeycomb core, and the honeycomb, the matrix, or both may be made from one or more thermally conductive materials, such as metals or metal alloys. A porous metal matrix can take a form including, but not limited to, a metallic mesh or weave, a sintered metal structure, a porous metal mass, or a reticulate metal foam. To create a honeycomb block at least partially filled with sintered metal or metal foam, green precursor powders, pastes, slurries, foams or suspensions, including a fraction of metal in powder or chemical form, and possibly also including one or more binders, liquids, polymeric foams, foaming agents, or nonmetallic powders or solids, can be introduced into the honeycomb, and then the metallic components can be bound together and the remaining ingredients expelled, using techniques including, but not limited to, drying and heating to a sintering point.

One aspect of the invention can include a method of manufacturing a porous article. The method can include providing a honeycomb structure and providing a metal or alloy in powdered or chemical form, which may or may not be mixed with one or more binders, liquids, foaming agents and/or nonmetallic powders, or coated on a polymeric foam, to form a slurry, paste, suspension, or coated foam. The method can further include the steps of at least partially filling the void space inside the honeycomb structure with the metallic powder or the slurry, paste, suspension, or coated foam, and binding the metallic particles using methods such as by sintering, and additionally removing binders, liquids, polymers, foaming agents and/or nonmetallic powders if present. The honeycomb structure can include any of the honeycomb core embodiments described herein.

One aspect of the invention includes a method for connecting honeycomb core, such as any of the honeycomb core embodiments described herein, wherein a bond may be produced using a high temperature method, including, but not limited to, soldering, brazing, sintering or welding, such that some or all of any previously established bonds connecting component ribbons of the honeycomb core may be damaged or destroyed, but such that the substantial shape of the honeycomb can be preserved through bonding to the face member.

One aspect of the invention includes a honeycomb structure for use in a heat exchanger. The honeycomb structure can include at least two contiguous open cells including a plurality of enclosing walls, wherein at least one of the total number of enclosing walls is substantially porous and at least one is substantially solid, and wherein fluid can flow through the at least one porous wall.

Another aspect of the invention can include a honeycomb structure including at least two corrugated ribbons, wherein at least one corrugated ribbon is substantially porous at least in part, and at least one corrugated ribbon is substantially solid at least in part. At least two corrugated ribbons can be bonded together at discrete locations along substantially parallel strips of each ribbon, such that the walls of the at least two corrugated ribbons form a substantially honeycombed structure.

A further aspect of the invention includes a method of manufacturing a honeycomb structure. The method can include the steps of providing a plurality of flat ribbons, wherein at least one flat ribbon is at least partially porous and at least one flat ribbon is at least partially solid, bonding the ribbons together along substantially parallel strips at a plurality of discrete locations on opposite faces of each ribbon, and expanding the bonded ribbons by pulling outwardly along an axis substantially perpendicular to the planes of the ribbons.

One aspect of the invention includes a method of manufacturing a honeycomb structure. The method can include the steps of providing a plurality of flat ribbons, wherein at least one flat ribbon is at least partially porous and at least one flat ribbon is at least partially solid, corrugating the plurality of flat ribbons, and bonding the corrugated ribbons together at discrete locations, wherein adjoining ribbons are bonded substantially at crests and troughs of their corrugations.

A further aspect of the invention includes a method of manufacturing a honeycomb structure. The method here includes the steps of providing a plurality of flat ribbons, wherein at least one flat ribbon is at least partially porous and at least one flat ribbon is at least partially solid, corrugating at least one of the flat ribbons, and bonding the corrugated and flat ribbons together at discrete locations.

An apparatus for heat exchange and storage is described, in one aspect of the invention. This apparatus can include a honeycomb structure, such as any of the honeycomb core embodiments described herein, at least one face member connected to a side of the honeycomb structure such that the connecting surface of the face member substantially conforms to or parallels the shape of the matching surface of the honeycomb over the area of connection, a connection between the honeycomb structure and the face member, a seal, and a phase change material. The phase change material can at least partially fill a sealed cavity formed between the honeycomb structure and the at least one face member.

One aspect of the invention includes an apparatus for use in a heat exchanger. The apparatus can include a honeycomb structure, such as any of the honeycomb core embodiments described herein, at least one tubular structure located proximate the honeycomb structure, and a connecting member connecting the honeycomb structure to the at least one tubular structure.

A cross-flow heat exchanger is described in one aspect of the invention. This cross-flow heat exchanger can include a honeycomb structure, such as any of the honeycomb core embodiments described herein, at least one face member connected to at least one side of the honeycomb structure, at least one opening on the at least one face member; and at least one flange to seal at least a portion of the connection between the honeycomb structure and at least one face member. The fluid can be channeled though the at least one opening and through at least a portion of the honeycomb structure. Alternatively, a cross-flow heat exchanger can include a honeycomb structure, such as any of the honeycomb core embodiments described herein, with at least one cell sealed on or near at least one of its ends, and at least one cell open on both of its ends and within its interior, so that fluid can be channeled through the at least one fully open cell in a direction parallel to its columnar axis.

A further aspect of the invention includes a plate-fin, cross-flow, or counter-flow heat exchanger. This can include at least one honeycomb structure, such as any of the honeycomb core embodiments described herein; and at least one conductive face member. The at least one conductive face member can be interleaved within the at least one honeycomb structure, such that each face member substantially conforms to or parallels the shape of the matching connecting surface of the honeycomb structure over the area of connection.

One method for the manufacture of a honeycomb structure is to adhere a stack of sheets or "ribbons" together along parallel strip-shaped junctions in alternating locations on each side of each stack interior ribbon, and then to expand the block so formed in order to create the final product by pulling the block's ends outwards along an axis substantially perpendicular to the planes of the stacked ribbons. This general method of manufacture, herein called an expansion method, may be used in some embodiments of the present invention. In these embodiments, assuming the use of an expansion method, hybrid honeycomb may be described, in part, by reference to formerly separate constituent parts, the ribbons. In some embodiments of this method, a single sheet can be folded over onto itself a plurality of times, functionally (and here, by definition) becoming a stack of separate ribbons which can later be expanded. In one embodiment, an extra section of material can be included at each fold, allowing the outer edges of the connecting ribbon pairs to be pulled apart during expansion. In an alternative embodiment, two or more folding sheets can be used.

In other embodiments of the invention, other methods of manufacture are possible, in which different processes and constituent parts are used (e.g. pre-corrugation methods in which at least some ribbons are corrugated prior to attachment, and in which expansion, or ribbon block pulling, may not be required to complete manufacture), or in which the honeycomb is produced as an integral whole (e.g. stamping, molding, extrusion and/or sintering methods). As such, any appropriate method, known to one skilled in the art, may be use to manufacture the honeycomb and other elements described herein.

Because honeycomb can be comprised of many repeating constituent parts, numbered labels in the figures described below may connect only to representative parts of each type named, and may not connect to all parts of each type named.

FIG. 1 gives a perspective view from above and directly in front of one embodiment of the invention (width axis 37 runs perpendicularly to the plane of the drawing sheet). The hybrid honeycomb block 71 of this embodiment may be similar in shape and form to traditional hexagonal honeycomb, with walls 21-24 intersecting at nodes 30 so as to define open columnar cells 29 with width 43, pitch 42 and height 44, with height measured along honeycomb thickness axis 35 (in the plane of the drawing sheet). Unlike traditional hexagonal honeycomb, some of the cell walls (21 and 23) in this embodiment are substantially porous, whereas the remaining cell walls are (22 and 24) substantially solid. A substantially porous wall or wall portion is defined here as possessing a plurality of interior pores or openings of any size, shape or pattern (hereafter simply either "pores" or "openings") such that gaseous fluids such as air can flow through the wall or portion readily—for example, a wall or portion with total porosity or open area falling between five and one hundred percent. In other exemplary embodiments the total porosity or open area may fall between twenty-five and one hundred percent, between fifty and one hundred percent, or between twenty five and seventy five percent. Other porosity ranges may also be applied, depending upon the specific requirements of the apparatus. All substantially porous walls and/or wall portions of an embodiment may have substantially the same porosity, falling within any of these ranges, or porosity may vary among porous walls and/or portions. A substantially solid or nonporous wall is defined here as a wall failing to meet the definition for being substantially porous. In one embodiment, the solid wall can be completely nonporous to all relevant fluids. In another embodiment, the solid wall may be adapted to be porous to certain fluids, but nonporous to other fluids. In this and future figures, cross hatching (e.g. walls 21, 23) is used to indicate substantially porous wall, whereas white areas (e.g. on wall 24) or shaded areas (e.g. on wall 22) without cross hatching indicate substantially solid wall. Furthermore, open face edges indicated by solid lines 51 denote substantially solid wall, whereas open face edges indicated by dashed lines 52 denote substantially porous wall. An open face of a honeycomb is defined as one of either faces where the open columnar cells meet, with an overhead appearance as depicted, in one example, in FIG. 7.

Figure 7:
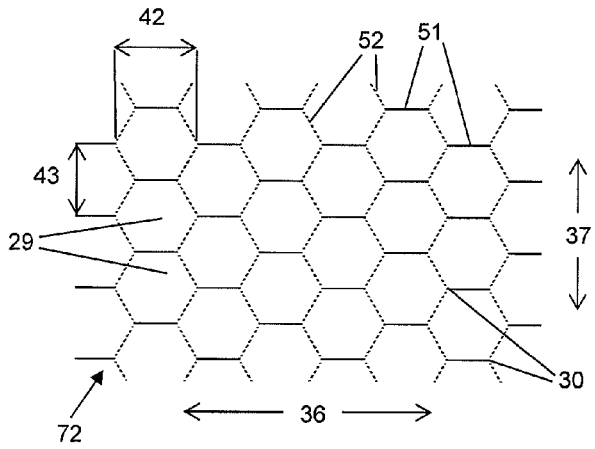
FIG. 7 shows a cross-section of hybrid honeycomb taken through a transverse plane, in accordance with one embodiment of the invention.

FIG. 7 gives an overhead or cross-sectional view of honeycomb 72, in this case the embodiment of FIG. 1, with a slightly different number of complete cell rows and columns shown. (It is implied that this and the other drawings of honeycomb in this document potentially represent small sections of larger areas of honeycomb block including many more cells and their defining walls; only small numbers of cells and walls are necessary to illustrate the present invention.) In one embodiment, cell width 43 and pitch 42 can both be less than one inch. As before, solid lines 51 indicate open face edges of substantially solid wall sections, whereas dashed lines 52 indicate open face edges of substantially porous wall sections, in this and other figures giving overhead views of honeycomb. FIG. 7 shows that, in this embodiment, fluid can flow across the entire block of honeycomb in substantially any direction along a transverse plane, namely a plane perpendicular to the axes running longitudinally through the honeycomb cells, or equivalently as defined by honeycomb block length axis 36 and width axis 37 (both in the plane of the drawing sheet), given that all cell longitudinal axes are substantially parallel. (In the case of a curved sheet of honeycomb with non-parallel cell axes, a transverse plane becomes and is understood as a curved transverse surface substantially perpendicular to each cell axis at the point of contact; the same essential principles then apply.)

Figure 2:
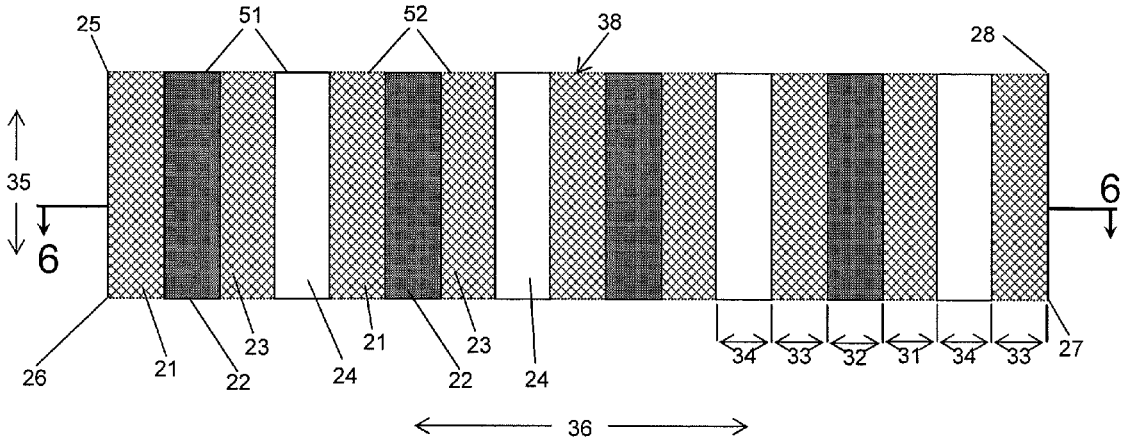
FIG. 2 shows one precursor ribbon for the manufacture of hybrid honeycomb via an expansion method, in accordance with one embodiment of the invention.

In an expansion method of manufacture, honeycomb block can be made from a stacked series of flat constituent ribbons, as described above. During the expansion process, each ribbon becomes corrugated, and remains so in the final honeycomb product. If the honeycomb of FIG. 1 is considered to have been manufactured by this method, then surface 38, as outlined by points 25, 26, 27 and 28, is a corrugated ribbon or a portion thereof. FIG. 2 illustrates a corresponding precursor flat ribbon.

According to one embodiment of the invention, FIG. 1 shows that front ribbon 38 is connected to second ribbon 41 at junctions 39, second ribbon 41 is connected to a third ribbon in sequence at junctions 40, and so forth and so on. Only a small subset of junctions in the diagram is labeled, and while labeling lines are drawn to the edges of junctions, an entire strip-shaped zone (running from the edges all the way along thickness axis 35) can be implied in each case. Accordingly, a connection can be implied at each drawn junction, not only the labeled ones—including, for example, the one junction between the front and second ribbons not labeled 39. The parts of a ribbon which meet at junctions (or, in the case of end ribbons, which would clearly meet at a junction if an additional ribbon were present and the same honeycomb pattern followed) are called junction strips (e.g. walls 22 and 24). In FIG. 1, all junction strips are parallel along their short axis to length axis 36, whereas free strips (e.g. walls 21 and 23), or ribbon sections that do not form junctions with other ribbon sections, are not parallel to length axis 36 along any axis. Junction strips from adjacent ribbons can connect to each other and so form walls of double thickness, whereas free strips comprise walls of single thickness.

In one embodiment and method of manufacture, and as depicted in FIG. 1, all junction strips are substantially solid, and all free strips are substantially porous, but in other embodiments this need not be the case.

Figure 33:
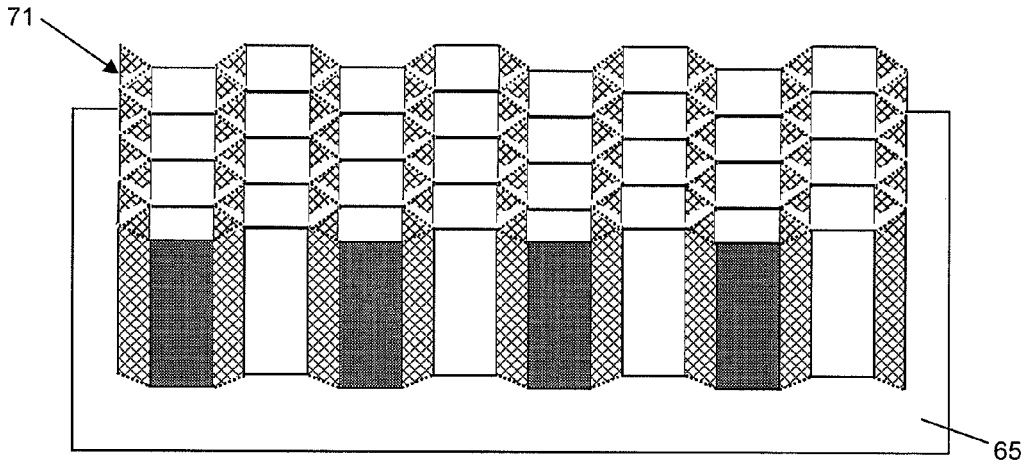
FIG. 33 shows a perspective view of hybrid honeycomb sheet attached to a face member, in accordance with one embodiment of the invention.

Active junction strips (e.g. 22) are shaded in FIGS. 1 and 2 and other perspective figures (e.g. FIG. 33) to indicate that they connect to adjacent ribbon, if present, on the side where the shading is shown. In figures depicting cross-sections of ribbon, such as FIGS. 6*a*, 6*b*, and 8, active junction strips, still indicated by shading, connect to adjacent ribbon, if present, in the downward direction of the page. Passive junction strips (e.g. 24) can be identified only by context, namely that they receive a connection from an adjoining active junction strip, and not by any particular shading or design. All these definitions of strips may not be relevant or applicable to honeycomb manufactured as one integral piece.

In one embodiment and method of manufacture, connecting junction strips (and thereby adjacent ribbons) can be joined by adhesive, such as, but not limited to, high temperature resistant epoxy. However, other methods of connection are possible as well, including, but not limited to, using other adhesives, soldering, brazing, sintering, or welding, or combinations thereof. In an alternative embodiment, mechanical connections, such as, but not limited to, screws and rivets, can also be used.

Ribbons or integral honeycomb walls can be made from a wide variety of pliable or foldable materials, including, but not limited to, ductile metals and alloys, various plastics, papers, and fibrous weaves. Integral walls can also be made from more brittle or frangible materials, additionally including, but not limited to, various ceramics, non-ductile metals, and certain plastics. Aluminum can be used in one embodiment, providing a strong, lightweight, thermally conductive and ductile material capable of service in expansion methods of manufacture. The aluminum (or an alternative constituent material) can be coated, laminated, or otherwise treated to modify properties which can include, but are not limited to, corrosion resistance, bonding performance, and other chemical properties.

In alternative embodiments, different ribbons in the same honeycomb can be made from different materials, in order to achieve a mix of attributes not easily available from just one material. Similarly, individual ribbons can be compositely formed from two or more fused, bonded, or otherwise connected layers, possibly of different material or physical organization; and ribbons of differing thicknesses can be used in the same honeycomb block.

Figure 3:
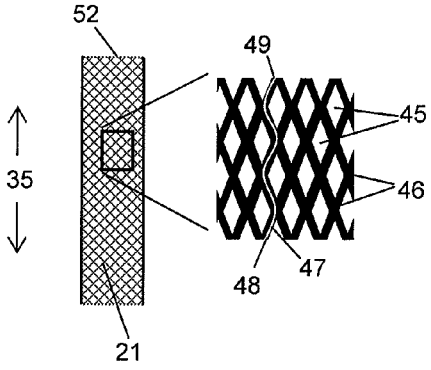
FIGS. 3-5 detail substantially porous wall, in both full and blown-up views, in accordance with several embodiments of the invention.
Figure 4:
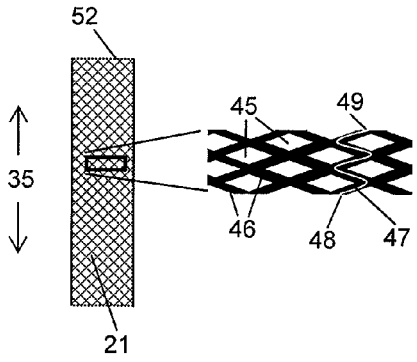
Figure 5:
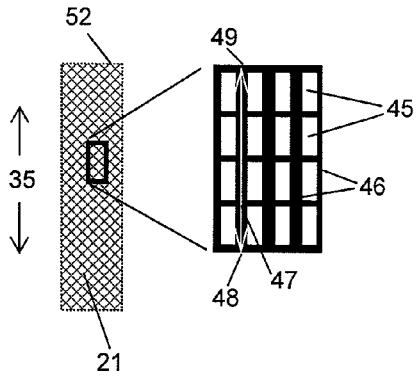

FIG. 3 shows one substantially porous strip of ribbon, excerpted from FIG. 2. Further, FIG. 3 shows a small blown-up section of the strip to reveal an alternating grid pattern of openings in the wall, with openings whose long axes run parallel to the honeycomb thickness axis 35, or perpendicularly to a transverse plane. White areas 45 represent voids, whereas shaded areas 46 represent wall material. Line 47 does not represent a physical entity, but rather illustrates the shortest path, through wall material, from point 48 to point 49. The sinuosity of such paths connecting points spaced along the honeycomb thickness axis 35 may be an important design feature for some heat exchange applications. The less sinuous the path, the more rapidly heat will be able to conduct through porous wall along the honeycomb thickness axis, all else being equal, due to the shorter path distance per axis distance traversed. FIG. 4 shows a porosity pattern with greater sinuosity than in FIG. 3, and pore long axes running perpendicularly to the honeycomb thickness axis; FIG. 5 shows a regular grid pattern of openings where some shortest paths have no sinuosity.

FIGS. 3-5 show a small subset of a range of possibilities for pore size, shape and pattern in the substantially porous wall sections. The optimum choice in any instance will be a matter of design objectives and manufacturing constraints. For example, arrangements that provide high surface areas of contact between wall material and fluid, while providing for relatively easy transverse flow and for rapid heat conduction along the honeycomb thickness axis, will generally be favored for heat exchange applications; and arrangements incorporating very small pores, or ranges of pores sizes, may be favored for filtering applications. (Note: pores with diameters that are small relative to the thickness of the walls in which they reside may not take such simple forms as suggested by FIGS. 3-5, but rather manifest as complex, and irregular three-dimensional passageways through wall.)

Substantially porous ribbon sections need not be restricted to strips spanning the full thickness of a honeycomb block, as shown in FIGS. 1-5. However, this can be advantageous in many embodiments of the invention, as each sheet of honeycomb created by slicing the finished honeycomb block in a transverse plane will have similar or identical transverse flow properties. Furthermore, the slitting and expansion method of manufacture for precursor ribbons (just below) may be possible in embodiments where porous strips span the full honeycomb block thickness.

The patterns in FIGS. 3 and 4 can be produced by slitting and expanding metallic foil or sheet, followed optionally by re-flattening (foil increases in thickness when slit and expanded), with no attendant waste of material. The pattern in FIG. 5 can be produced by perforating a previously solid foil or sheet, which may lead to some wastage. FIG. 3 depicts an example embodiment. Precursor ribbon, such as the one shown in FIG. 2, can then be created by a method of manufacture in which alternate strips of an integral piece of aluminum foil stock are either slit, expanded, and re-flattened, or left intact, to efficiently produce any pattern of substantially porous and substantially solid strips on the ribbon for subsequent use in honeycomb manufacture. Furthermore, for some applications FIG. 3 may be preferred over FIG. 4 because of the relatively direct path available for heat exchange along the honeycomb thickness axis 35.

In one embodiment, overall porosity can preferably be high, such as greater than 25%, and mean opening size may be preferably greater than ribbon thickness, in order to provide for sufficiently low flow resistance. Other porosity values and ranges can also be advantageous, depending upon the particular requirements for the honeycomb. For example, in an alternative embodiment the porosity can be as low as 5%, as high as 95%, or anywhere therebetween.

In an alternative embodiment, porous portions can be produced at smaller portions of the ribbon, for example in sections that do not extend the full width of the ribbon. These porous portions can be placed in a substantially central location over the width of the honeycomb, or be placed towards one or another side edge of the honeycomb. These porous portions can be rectangular, oval, or of any appropriate shape, size, and orientation. These smaller porous portions, extending over only part of the width of a honeycomb ribbon, can be used to control flow through the resulting honeycomb and/or provide increased structural stability over porous regions extending over the entire width of the honeycomb ribbon.

Alternative embodiments can use other methods for the generation of compositely porous and solid ribbons, or purely porous ribbons, or alternately porous and solid walls in integrally manufactured honeycomb. Possible methods include, but are not limited to, chemical or laser treatment of substantially solid material to introduce pores; integral processes that create pores and wall simultaneously, such as sintering powdered metal or weaving fibers together into a mesh, felt, or screen; or the creation of substantially solid surfaces on sections of material that were previously substantially porous, for example by the compression, brazing, or soldering of porous sintered metal wall, the use of a sealant or adhesive on porous wall, or the addition of one or more substantially solid laminate layers.

Figure 6A:
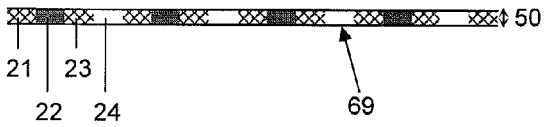
FIG. 6*a* shows a cross-sectional view of precursor ribbon as shown in FIG. 2.
Figure 6B:
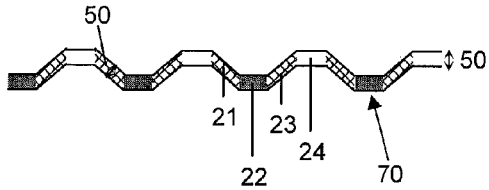
FIG. 6*b* shows a cross-sectional view of pre-corrugated precursor ribbon, in accordance with one embodiment of the invention.

FIG. 6*a* depicts the cross-section of a flat precursor ribbon 69 as marked in FIG. 2 by the cross-section lines labeled 6 in large bold type. The parallel lines which sandwich the ribbon sections shown do not represent an additional physical material, but are included for visual clarity to provide a boundary to the object. Ribbon thickness 50 can be made exceptionally thin, leading to very high surface area to volume ratios advantageous for heat exchange applications. Major manufacturers of honeycomb currently make walls at least as thin as 0.0007 inches (e.g. Hexcel), and metallic foils at least as thin as 0.00006 inches are available (e.g. from Hamilton Precision Metals). One embodiment of the invention can utilize similarly thin walls, although thinner or thicker walls may be utilized, as required. FIG. 6*b* shows the cross-section of a pre-corrugated ribbon 70 of the same general pattern; pre-corrugated ribbons are used in pre-corrugation manufacture methods.

Figure 8:
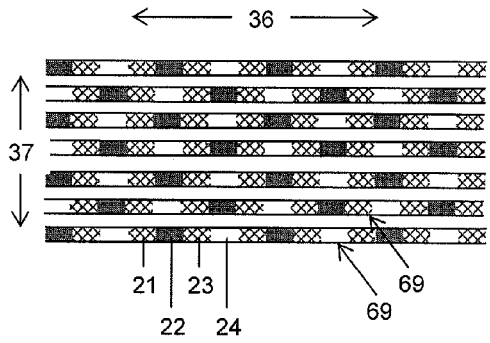
FIG. 8 shows cross-sectional views of precursor ribbons of a nature and in a pattern, order and alignment allowing assembly into the hybrid honeycomb of FIGS. 1 and 7.

FIG. 8 gives the cross-section of several separate ribbons, each in the style of FIG. 6*a*. FIG. 8 shows the type and patterning of ribbon that would, in one embodiment, be required to create a honeycomb patterned after FIGS. 1 and 7.

In FIG. 8, and all other figures depicting ribbon cross-sections, as previously noted, the shaded sections indicate active junction strips that connect to adjacent ribbon, if present, in the downward direction of the page.

Figure 9:
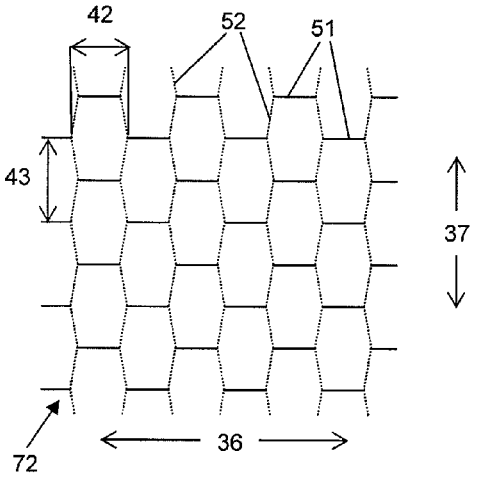
FIG. 9 shows a cross-sectional view of an overexpanded hybrid honeycomb, in accordance with one embodiment of the invention.
Figure 10:
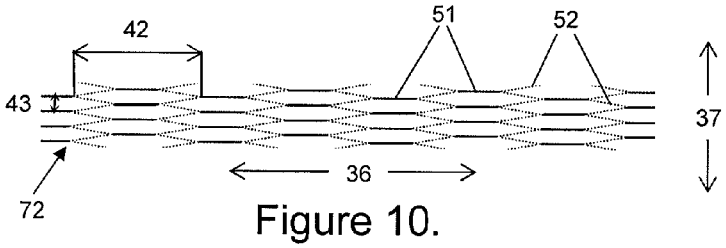
FIG. 10 shows a cross-sectional view of an underexpanded hybrid honeycomb, in accordance with one embodiment of the invention.

In the expansion method of honeycomb manufacture, as described above, separate ribbons are bonded together along patterned junction strips, and then expanded to form honeycomb. Typically in extant embodiments, junction strips are arranged and expansion executed so that the result is a honeycomb block with hexagonal cells, as illustrated by the transition from the precursor ribbon arrangement in FIG. 8 to the expanded block cross-section in FIG. 7. However, the block can be overexpanded or underexpanded, to produce results such as those illustrated in FIGS. 9 and 10, respectively, which here correspond in their illustrated dimensions with FIG. 7 such that all three embodiments could be produced by the same set of connected precursor ribbons, expanded to differing degrees. Thus it is evident that differing degrees of expansion can be used to tune many different attributes of honeycomb block, including, but not limited to, cell density, cell pitch 42 and width 43, block length and width (for a given amount of ribbon material), the void to solid volume ratio, resistance to transverse flow (by changing the density and angles of porous walls), and resistance to flow along cellular axes (by changing channel dimensions). Many or all of these attributes have clear implications for many potential applications, including, but not limited to, structural, heat exchange and filtration ones.

Figure 31:
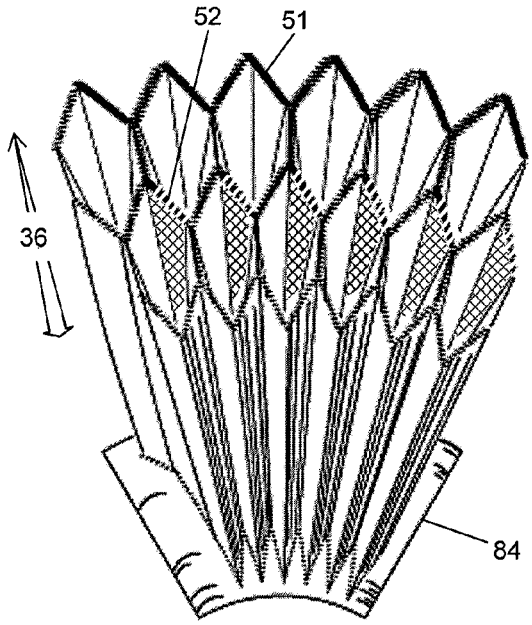
FIG. 31 shows a perspective view of underexpanded honeycomb bonded to a curved face plate, in accordance with one embodiment of the invention.

A special consequence of underexpansion is that it can produce flexibility in a honeycomb block for bending around the length axis 36 (see FIG. 1). The thinner the block (along axis 35) and the less expanded it is, the smaller the radius of curvature attainable without unduly stressing, deforming, or sundering junction strips. FIG. 31 shows an example of underexpanded hybrid honeycomb that has been curved. The honeycomb is attached at one open face to a curved face member 84. The honeycomb can be underexpanded at the surface of attachment, and somewhat more expanded at its opposite open face. Nonetheless, even at the free open face, the cells are not up to standard expansion (in one embodiment, all cell walls are of equal length, so open faces would show regular hexagons at standard full expansion). This demonstrates room for further curvature before strain would be placed on junction bonds. The flexibility in underexpanded honeycomb can represent an important structural and manufacturing advantage for many applications involving curved surfaces.

One consequence of overexpansion is that some kinds of porous wall types can stretch and/or deform when pulled with sufficient force, as could be caused by honeycomb block overexpansion. This may be true for slit and expanded metallic foil. The deformation can produce effects advantageous for certain design goals. For example, flattened expanded foil frames each opening within it with a flattened foil border, like a plain, flat frame for a picture. If the foil is stretched, the frame walls can turn toward perpendicular with respect to their original orientation while the opening inside the frame enlarges. This should typically facilitate through-wall fluid flow, and thereby enhance design in many cases where ease of through-wall flow (or minimizing pressure drop caused by the material) is important.

Expansion methods represent only one approach for manufacturing honeycomb that bears the appearance of underexpansion or overexpansion. Extrusion methods, for example, can be used to produce honeycomb with cells of any shape or shapes that can tessellate to fill a plane. More broadly, while the examples used to illustrate the present invention all involve honeycomb with constituent cells that have four or six walls and a limited number of shapes, cell wall numbers (including both greater and fewer cell walls), shapes and mixes of shapes other than those shown can be used in alternative embodiments.

Varying the degree of block expansion, or, more broadly, cell shape, is one way to advance different design goals in the present invention. Another is varying the pattern of substantially porous and solid wall sections, as illustrated, for example, in FIGS. 11-20. This can be achieved in expansion and pre-corrugation methods by varying the pattern of substantially porous and solid strips within ribbons, and also by varying the mix of patterns used on different ribbons and the alignment and ordering of constituent ribbons in constituting a block. In methods that begin by forming an integral substantially solid honeycomb block, pores must subsequently be introduced selectively into various honeycomb walls by techniques that might include but are not limited to perforation, chemical treatment, and laser treatment. In methods that begin by forming an integral substantially porous honeycomb block, substantially solid sections or walls must be selectively created by techniques that might include, but are not limited to, use of sealant, adhesive, laminate, or mechanical pressure (which can seal the fine pores at the surface of sintered metal).

Variations generated by such means have important consequences for honeycomb characteristics including, but not limited to, the nature of transverse fluid flow, surface area of exposure of fluid to wall material, structural strength, and the smoothness of and capacity for mechanical energy absorption.

Figure 11:
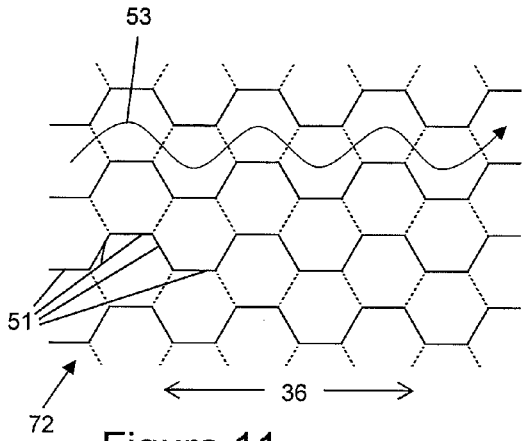
FIGS. 11, 13, 15, and 17 show cross-sectional views of hybrid honeycombs that channel transverse plane fluid flow in a variety of ways, in accordance with several embodiments of the invention.
Figure 12:
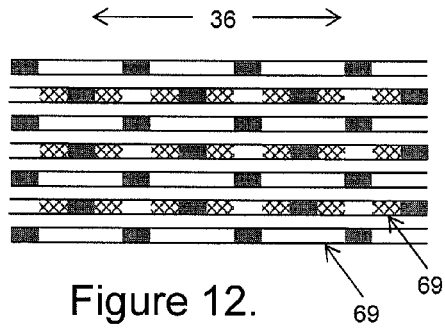
FIGS. 12, 14, 16 and 18 show, respectively, cross-sectional views of precursor ribbons for the embodiments depicted in FIGS. 11, 13, 15, and 17, of a nature and in patterns, orders and alignments allowing assembly into these embodiments.
Figure 13:
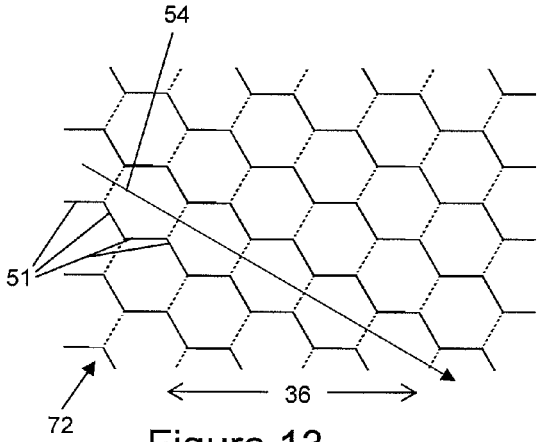
Figure 14:
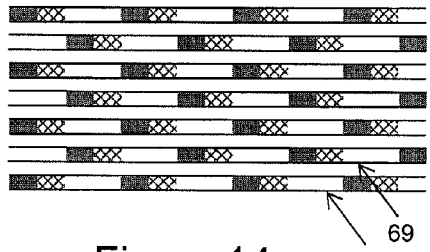
Figure 15:
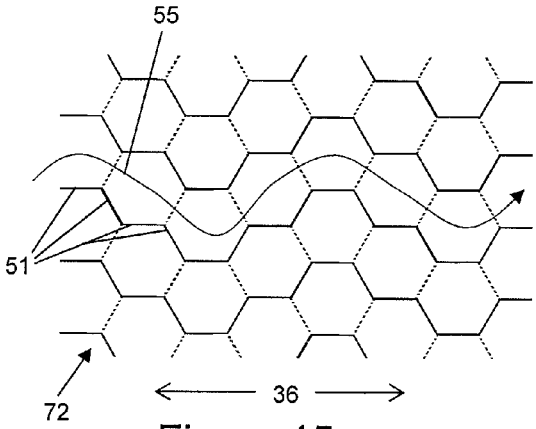
Figure 16:
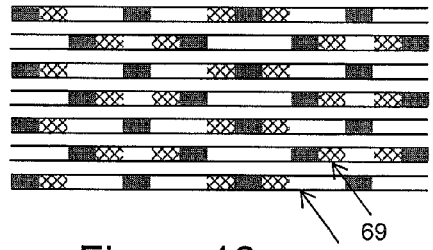
Figure 17:
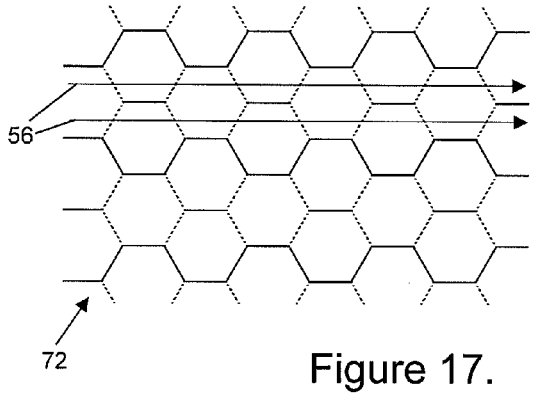
Figure 18:
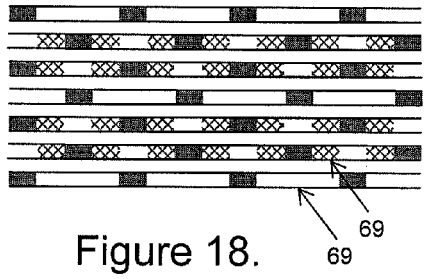

FIG. 11 shows one possible pattern of substantially porous and substantially solid cell walls in a honeycomb block, in which any transverse fluid flow is forced through separate channels. Arrow 53 illustrates one possible path of flow and follows one channel. FIG. 12 shows a patterning of precursor, constituent ribbons that could produce hybrid honeycomb as shown in FIG. 11 if using an expansion method. FIGS. 13, 15, and 17 show additional, differently patterned embodiments (all also dividing the honeycomb into separate channels, and with respective representative flow arrows 54, 55, and 56), while FIGS. 14, 16, and 18 illustrate corresponding patterns of ribbon, respectively, still assuming an expansion method of manufacture. These examples show that patterns can be varied to influence flow channel width, direction, and sinuosity, and other elements of geometry, which factors in turn influence path length, flow turbulence, and pressure drop across the block, all elements advantageous to tune in different ways for different applications. For example, increased flow turbulence may enhance heat exchange between a flowing fluid and a honeycomb.

Figure 36:
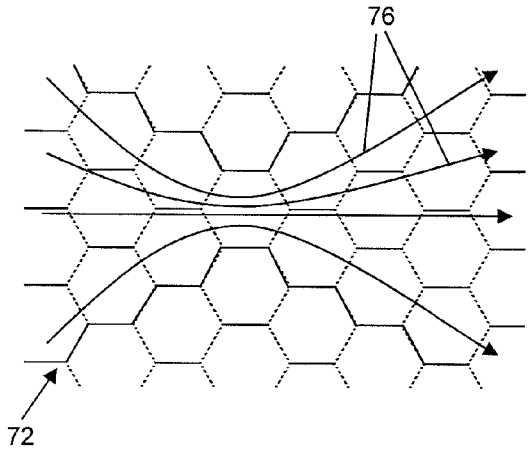
FIGS. 36-37 show cross-sectional views of hybrid honeycombs that channel transverse plane fluid flow in a variety of ways, in accordance with one embodiment of the invention.
Figure 37:
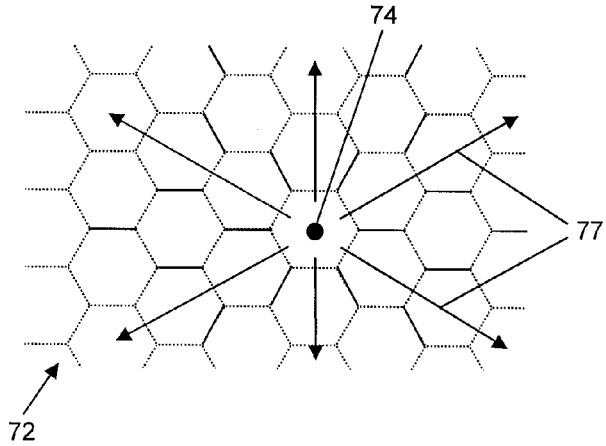

FIG. 36 shows a "bowtie" embodiment (without the corresponding ribbon diagram) in which solid walls define a channel of varying width. As a result, given a constant fluid flow (illustrated by arrows 76) through the channel (as might be forced, for example, by a fan) different regions may experience different velocities of flow. FIG. 37 shows an "exploding" embodiment in which solid walls are positioned so as to enhance flow 77 away from a central point 75 in a transverse plane, as might be useful were flow to be directed toward the central point along an axis perpendicular to the transverse plane. In general, the possibilities for patterning solid walls to channel flow are multitudinous; the attempt here is only to give a small sampling suggestive of the range of possibilities.

Figure 19:
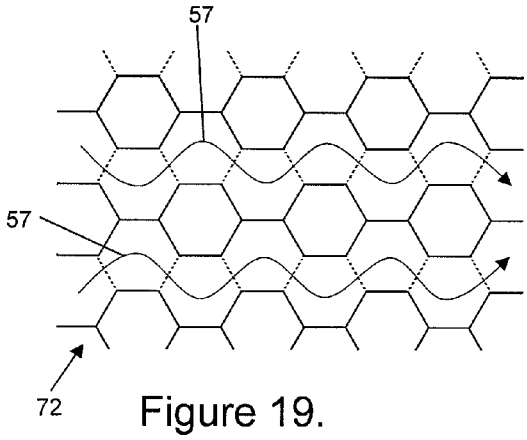
FIGS. 19 and 20 show cross-sectional views of hybrid honeycomb embodiments in which some cells are sealed off to flow in the transverse plane, in accordance with one embodiment of the invention.
Figure 20:
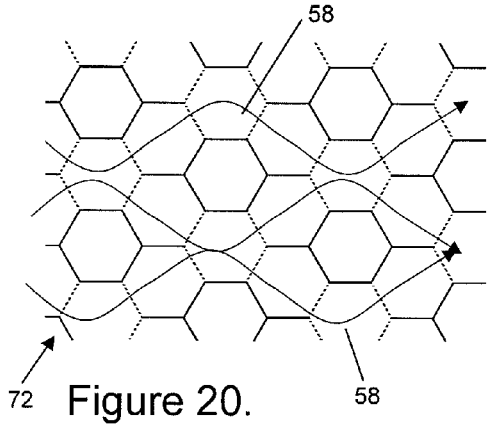

FIGS. 19 and 20 show two more embodiments which include some cells with all walls substantially solid. This feature can be advantageous for many possible reasons, such as to lend greater strength and structural support to the honeycomb block along thickness axis 35. Another advantage is to create an opportunity for cross-flow heat exchange. While one or more fluids flow through the honeycomb walls in the direction of arrows 57 or 58, one or more other fluids could flow through the closed-wall cells parallel to axis 35 (see FIG. 1), and remain separate from the transverse flowing fluid or fluids. Similar advantages could accrue for embodiments in which substantially solid walls surround one or more cell groups, and in which porous wall portions are arranged to permit transverse or cross-wall fluid flow around at least one such cell group.

Figure 46:
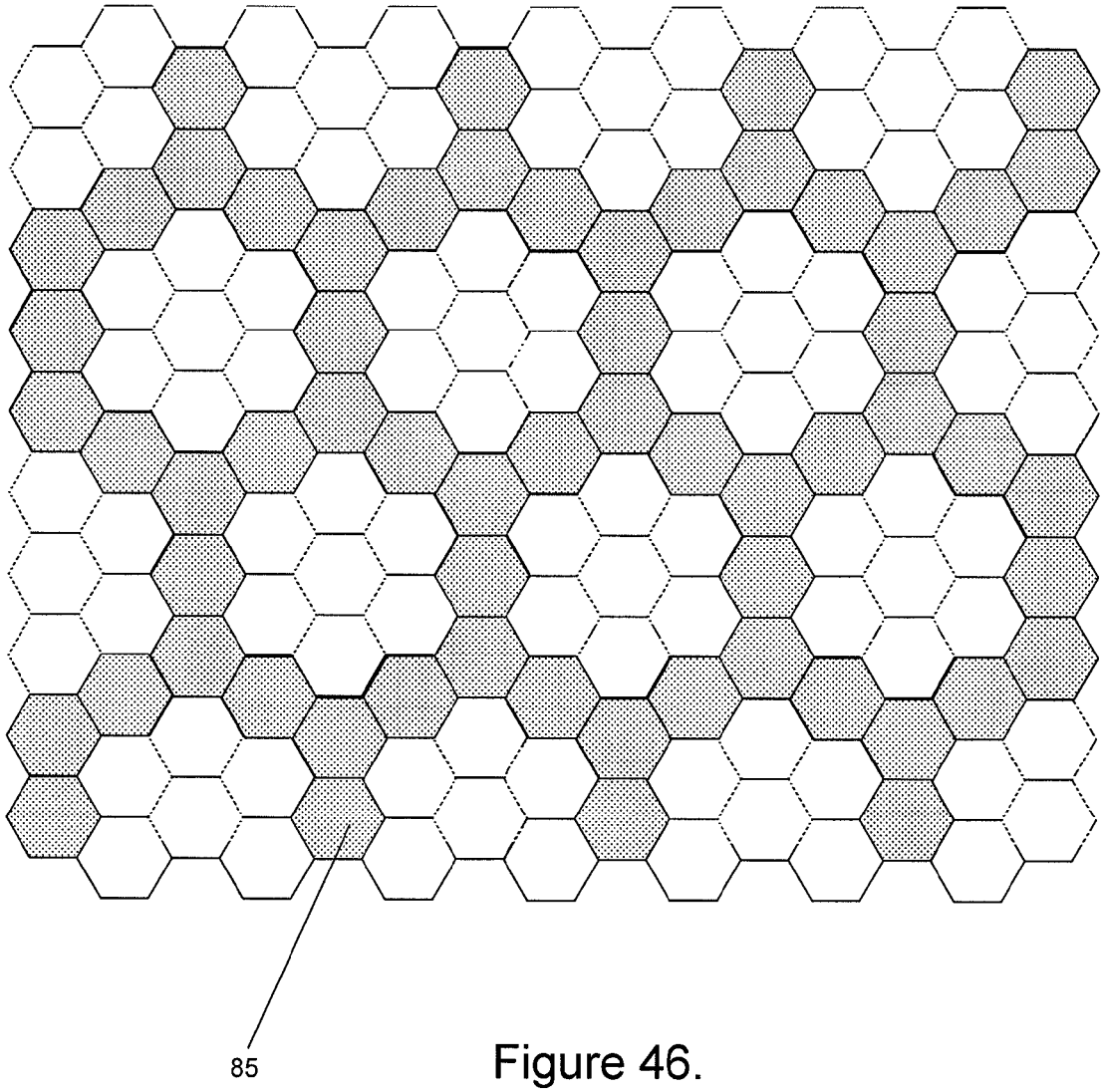
FIG. 46 shows a plan view of a honeycomb structure wherein at least one cell group is surrounded by substantially nonporous cell walls, in accordance with one embodiment of the invention.

FIG. 46 illustrates one embodiment in which substantially solid walls surround a plurality of cell groups. In this embodiment, nonporous cell walls are arranged in such a way as to create a second-order honeycomb pattern out of honeycomb cells with all solid walls, as indicated by the shaded cells 85 in the figure. (The shading is meant for visual guidance only, and not to designate any physical object or property.) The resulting "hyper-honeycomb" may offer structural strength approaching the strength provided by traditional solid-walled honeycomb of similar specifications, but at a lesser weight.

Figure 47:
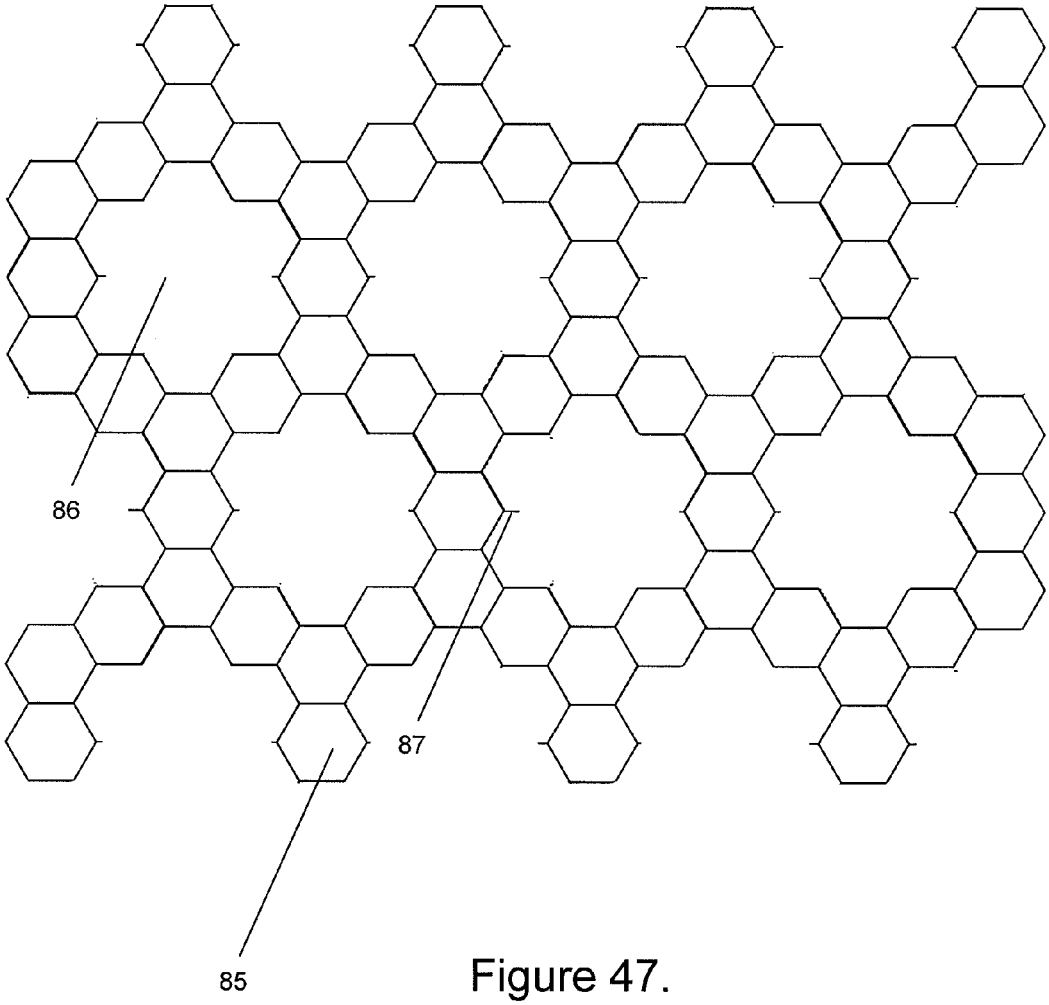
FIG. 47 shows a plan view of the honeycomb structure of FIG. 46, wherein a number of interior walls of the cell groups have been removed.

FIG. 47 shows another embodiment in which substantially solid walls surround a plurality of cell groups, and further in which interior walls and wall portions have been removed from the cell groups. The resulting hyper-honeycomb embodiment may offer similar structural strength to embodiments in which interior walls are left intact, but at reduced weight.

While FIGS. 46-47 illustrate hyper-honeycomb with regular hyper-cells (the unshaded cells in FIG. 46, or the interior areas 86 in FIG. 47, defined by the simple honeycomb cells with all solid walls 85 tracing the second-order honeycomb pattern) defined by the simple honeycomb cells with all solid walls 85), other embodiments can include hyper-cells of different sizes, shapes, and arrangements, within and among embodiments. Furthermore, while FIGS. 46-47 show second-order hyper-honeycomb, in which simple solid-walled cells are arranged to define second-order hyper-cells, higher-order embodiments are possible in which, for example, second-order hyper-cells are arranged to define third-order cells, and so forth and so on.

Hyper-honeycomb embodiments may be manufactured by expansion methods employing a plurality of ribbons, wherein at least one of the ribbons comprises at least one substantially porous portion, wherein at least one of the ribbons comprises at least one substantially nonporous portion, and wherein porous and nonporous portions are appropriately arranged. Further embodiments can be manufactured by removing cell walls, and/or cell wall portions, from within an existing hyper-honeycomb before or after expansion. Porous ribbon portions can facilitate this removal by offering weakened links that are easier to separate, sever, dissolve or otherwise disconnect, much as perforations can facilitate the detachment of paper stubs. Some embodiments of hyper-honeycomb can also be manufactured by removing cell walls, and/or cell wall portions, from traditional solid-walled honeycomb lacking any porous wall portions.

An embodiment such as FIG. 47 can be manufactured via an expansion method with cell wall removal, or by other methods. In former such cases, stubs such as stub 87 may represent two partial junction strips connecting two ribbons (in FIG. 47, assuming manufacture by expansion method, ribbons run across the short axis or width of the page, so that all line segments parallel to the top and bottom of the page represent junctions where two ribbons connect, whereas diagonal segments are single-thickness). Intact partial or complete connected junction strips adjacent to solid-walled simple cells defining higher-order cells can help ensure the structural strength of hybrid honeycomb manufactured by expansion and wall removal.

Figure 21:
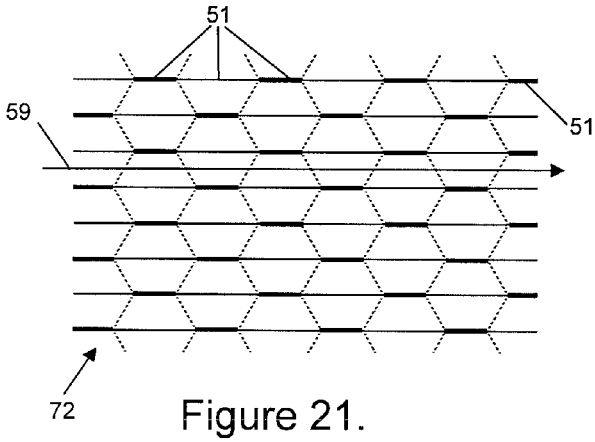
FIG. 21 shows a cross-sectional view of a reinforced hybrid honeycomb, in accordance with one embodiment of the invention.
Figure 22:
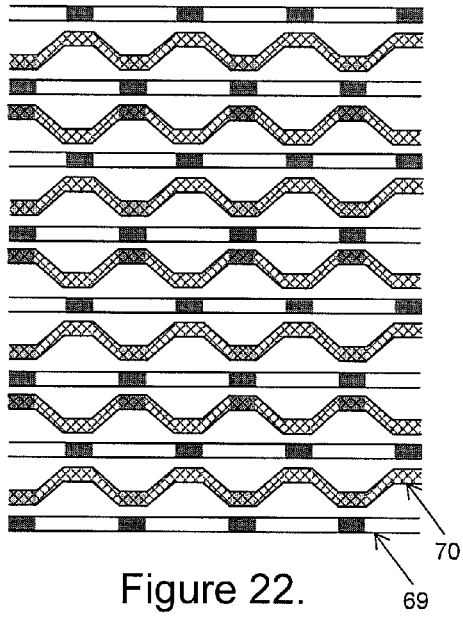
FIG. 22 shows a cross-sectional view of precursor ribbons of a nature and in a pattern, order and alignment allowing assembly into the embodiment of FIG. 21.

FIG. 21 illustrates another embodiment of the present invention. Reinforced hybrid honeycomb can be manufactured by corrugating some ribbons in advance, and then bonding them to flat ribbons in the pattern suggested by FIGS. 21 and 22. In embodiments where a sufficient number of free strips are substantially porous, particularly if openings have been introduced by slitting and expansion, it may also be possible to bond all sheets together while they are all flat, and then expand the block slightly, taking advantage of the stretching capability of some types of porous wall, particularly slit and expanded foil. Whether pre-corrugation, expansion, or other methods of manufacture are employed, FIG. 22 shows a general patterning of ribbon sufficient to achieve the result shown in FIG. 21 using a pre-corrugation method of manufacture. Ribbons to be pre-corrugated are shown in this state. (Also note that in the embodiment of FIG. 22, 100% substantially porous pre-corrugated ribbons are to be used, and bonds will join substantially porous and substantially solid junction strips to construct the final honeycomb. These elements are not required for the construction of the embodiment shown in FIG. 21—the pre-corrugated ribbons could have substantially solid junction strips—but are shown here to suggest the possibility.)

Potential advantages of reinforced hybrid honeycomb can include, but are not limited to, structural strengthening and creation of linear channels for transverse flow.

Figure 38:
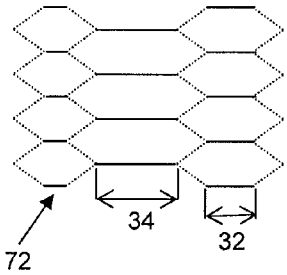
FIGS. 38-40 show cross-sectional views of hybrid honeycomb with varying within-honeycomb cell geometries, in accordance with one embodiment of the invention.
Figure 39:
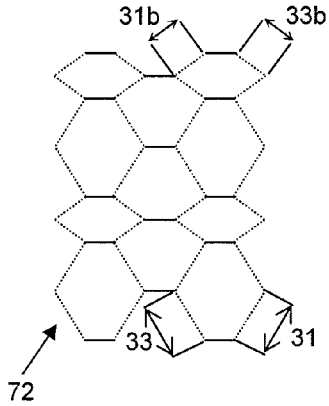
Figure 40:
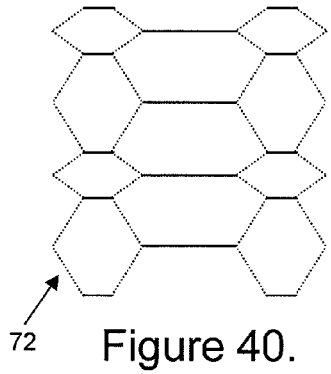

Another technique for manipulating the form and function of finished hybrid honeycomb, in the context of expansion or pre-corrugation methods of manufacture, is to vary the widths of junction strips and free strips. Proportional increases or decreases applied to all strips can maintain cell shape while increasing or decreasing cell size, respectively. The width of junction strips (e.g. 32, 34) can also be varied independently of the width of free strips, as in FIG. 38. Similarly, the width of free strips (e.g. 31, 33) can be varied independently of junction strips, as in FIG. 39. If free strips have different widths on different ribbons, as in free strips 31*b* and 33*b*, when compared to 31 and 33, a pre-corrugation (or integral) method may be preferred for manufacture, since matching junction strips would not line up properly on separate flat ribbons with free strips of different widths. Alternatively, free strip folding prior to ribbon stacking, or stretching during stack expansion, may allow an expansion method. FIG. 40 shows a honeycomb cross-section in which both junction strips and free strips have variable widths. Complex geometries may generally favor corrugation methods over expansion methods, and integral methods over corrugation methods.

Different cell sizes, shapes and patterns may thus be generated in honeycomb manufactured by expansion or pre-corrugation methods. For methods that produce integral honeycomb and do not involve constituent ribbons, a wider range of geometries can be achieved, for example, by selection of an extrusion mold producing cells of the desired size, shape, and pattern.

Figure 23:
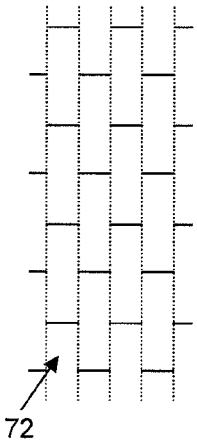
FIG. 23 shows a cross-sectional view of an overexpanded hybrid honeycomb with junction strips narrower than free strips, in accordance with one embodiment of the invention.
Figure 24:
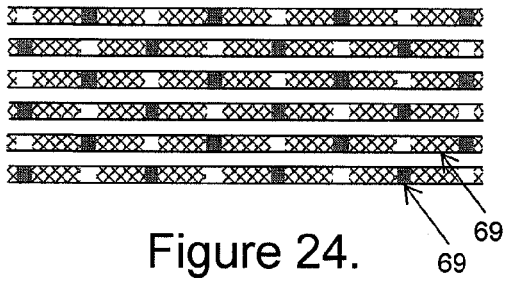
FIG. 24 shows a cross-sectional view of precursor ribbons of a nature and in a pattern, order and alignment allowing assembly into the embodiment of FIG. 23.
Figure 25:
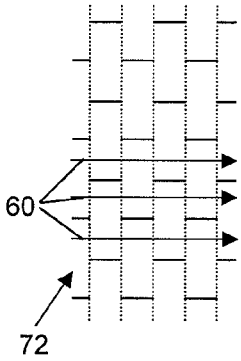
FIGS. 25 and 26 illustrate consequences of different overall fluid flow directions within the transverse plane for the embodiment of FIG. 23.
Figure 26:
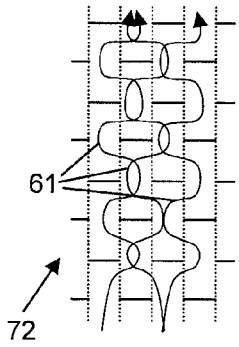

FIG. 23 shows an embodiment of overexpanded hybrid honeycomb where junction strips are narrower than free strips; FIG. 24 gives a corresponding ribbon and strip pattern for manufacture by an expansion method. FIGS. 25 and 26 show identical versions of a similar embodiment, and illustrate how mode of operation can elicit different properties from the same material. In FIG. 25, transverse fluid flow 60, predominantly along a first axis, can lead to relatively smooth, linear and parallel flow, whereas in FIG. 26, transverse fluid flow 61, predominantly along an orthogonal axis, can lead to sinuous and turbulent flow. Further differences between the embodiments include, but are not limited to, the angle of fluid crossing porous wall, pressure drop per unit distance measured along the main axis of flow, and exposure to wall surface area per distance traversed along the main axis of flow.

Figure 27:
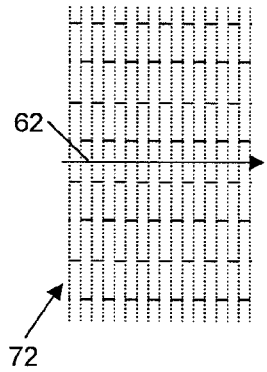
FIG. 27 shows a cross-sectional view of a hybrid honeycomb similar to the embodiment of FIG. 23 embodiment, but with more tightly packed components, in accordance with one embodiment of the invention.

FIG. 27 illustrates that overexpanded hybrid honeycomb with narrow junction strips can be used to create a relatively high-density, multi-layered porous matrix or filter, potentially not unlike many metallic foams in surface area to volume ratio, but much more organized in structure. A sample fluid flow is illustrated by 62.

Figure 28:
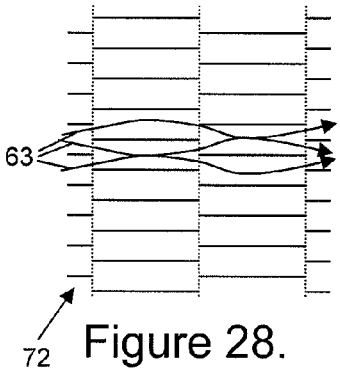
FIG. 28 shows a cross-sectional view of an overexpanded hybrid honeycomb with junction strips wider than free strips, in accordance with one embodiment of the invention.
Figure 29:
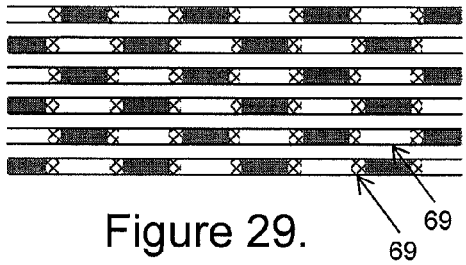
FIG. 29 shows a cross-sectional view of precursor ribbons of a nature and in a pattern, order and alignment allowing assembly into the embodiment of FIG. 28.

FIG. 28 depicts overexpanded hybrid honeycomb where junction strips are wider than free strips, and an associated flow pattern 63. FIG. 29 gives a corresponding ribbon and strip pattern. In this embodiment, as the junction strips are substantially solid, fluid flow in the direction parallel to the junctions will be fairly well channeled.

Figure 30:
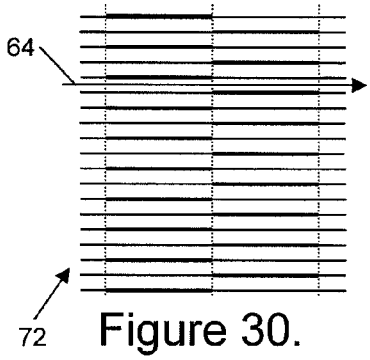
FIG. 30 shows a cross-sectional view of a highly channelized hybrid honeycomb embodiment, in accordance with one embodiment of the invention.

FIG. 30 depicts a similar hybrid honeycomb embodiment as FIG. 28, but constructed so that fluid flow 64 is strictly canalized into separate channels. This embodiment can be manufactured by a corrugation method, with reinforcement from flat ribbons, or by an integral method.

Figure 32:
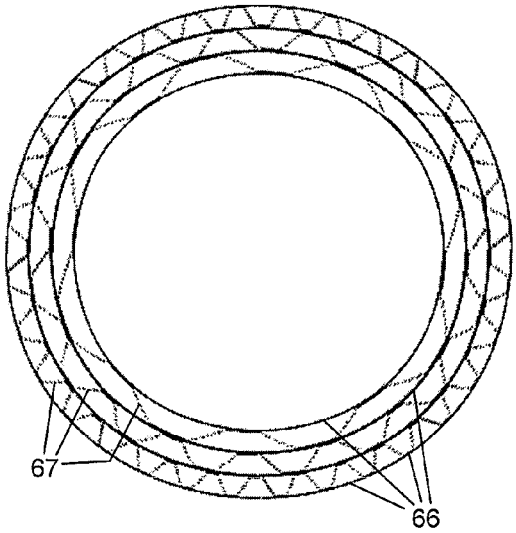
FIG. 32 shows a cross-sectional view of annular honeycomb formed by a pre-corrugation method, in accordance with one embodiment of the invention.

A further basic variant, shown in cross-section in FIG. 32, is hybrid honeycomb with curved or annular open faces upon manufacture, instead of rectangular open faces as previously implied and depicted. To construct the annular hybrid honeycomb, for example, layers of pre-corrugated ribbon 67 (in this illustration, the corrugated ribbon is substantially porous; also, different corrugations are used in different layers) are wrapped around a cylindrical mold. Flat ribbon 66 can be interleaved between some or all of the pre-corrugated ribbons, and may be used for the innermost and/or outermost layers as well, as it is in this case. Each layer is bonded or fused to the adjacent layer or layers. A portion of the constituent ribbon material is substantially porous, and a portion in substantially solid. Many variants are possible, as suggested by the variations described for non-annular hybrid honeycomb: ribbons can be of varying thicknesses, pre-corrugated ribbons can have different corrugation amplitudes, etc. In alternative embodiments, the honeycomb can be constructed to form other shapes, including, but not limited to, ovals, one or two dimensional curved surfaces, or any other appropriate shape.

Figure 44:
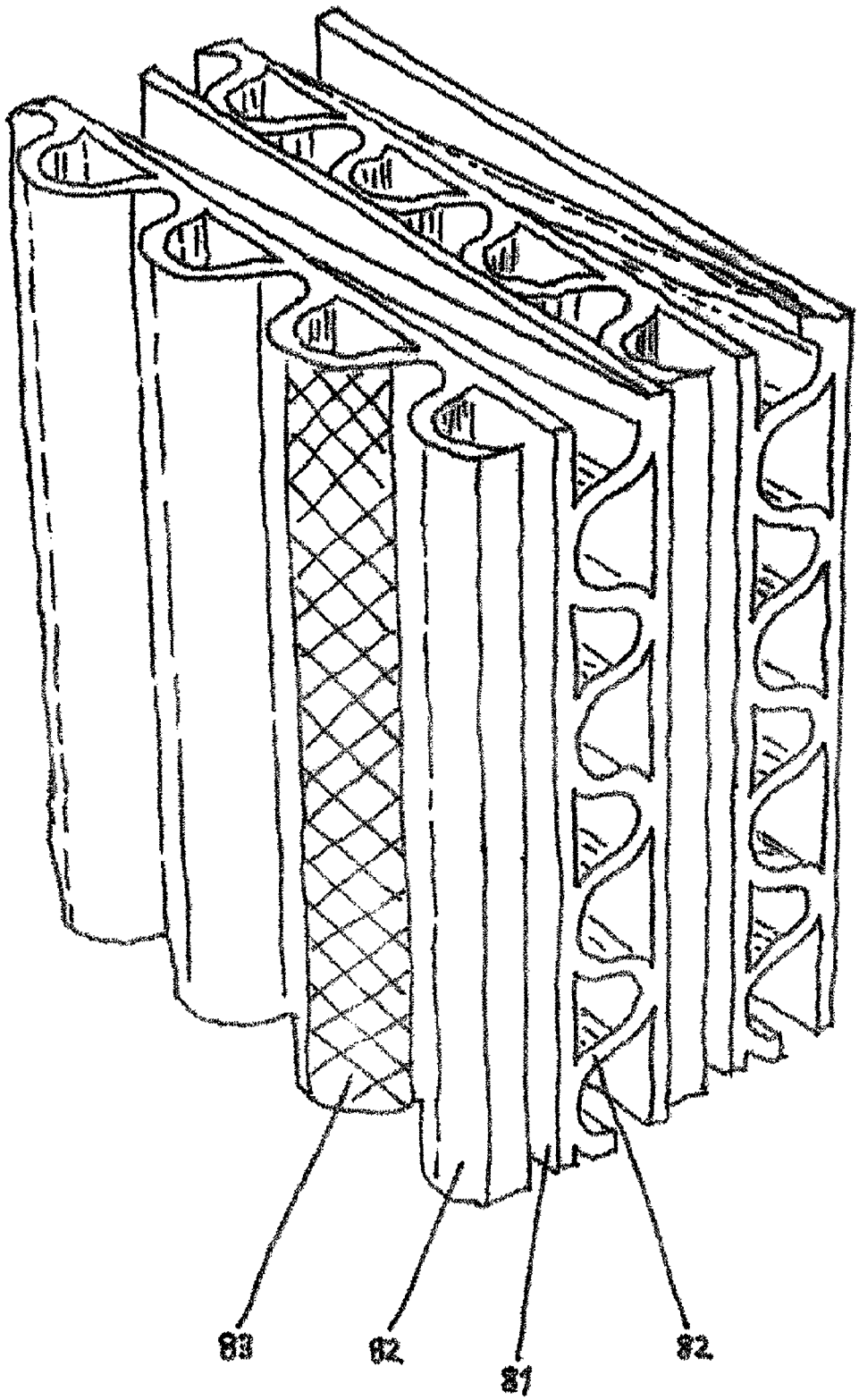
FIGS. 44-45 show perspective views of cross-corrugated hybrid honeycomb, in accordance with two embodiments of the invention.
Figure 45:
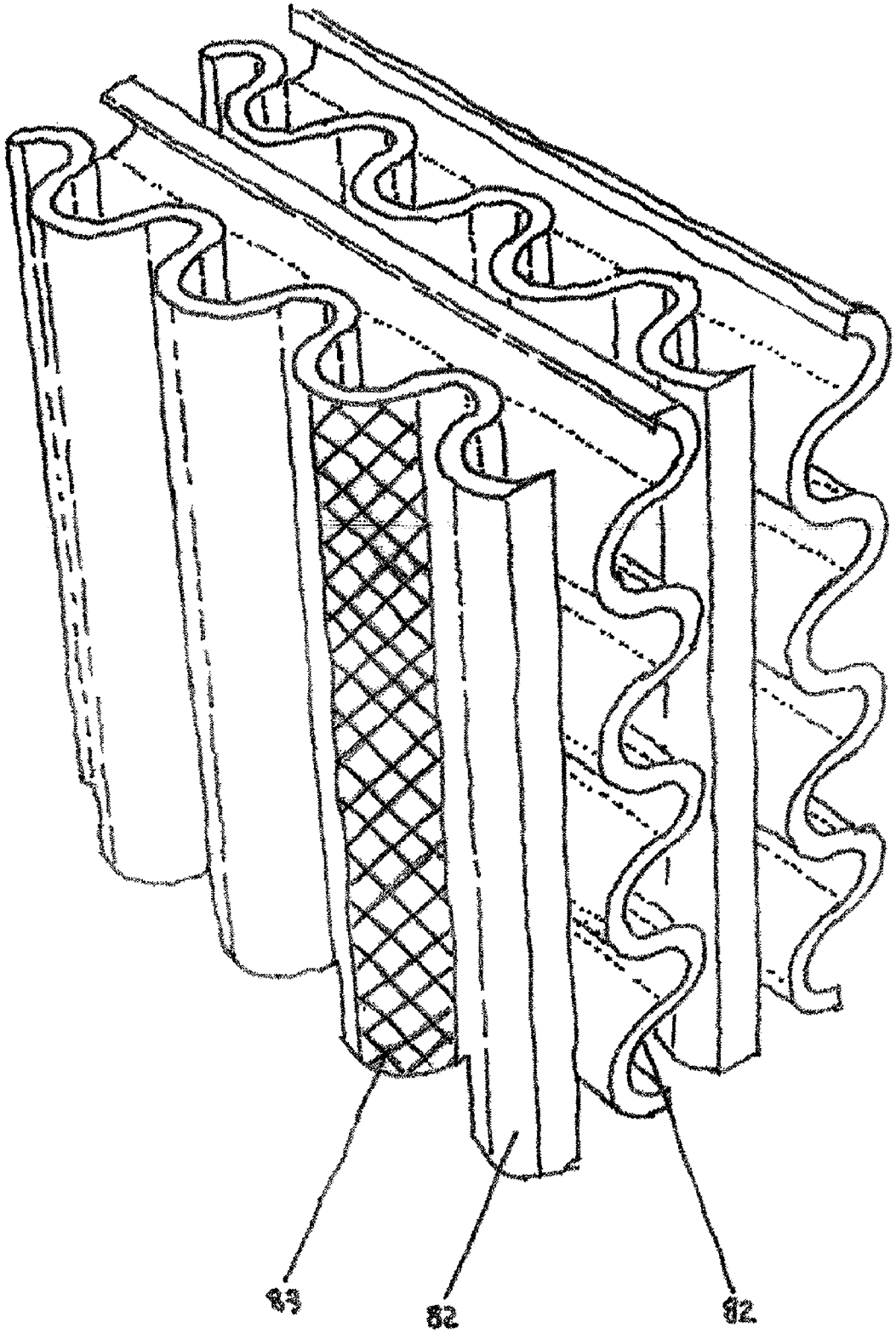

Another variant of the invention can be a cross-corrugated hybrid honeycomb, wherein different layers of pre-corrugated ribbon are oriented with corrugations substantially orthogonal to each other, and not parallel, as heretofore implied and depicted. Flat ribbon can adjoin some or all corrugated ribbons. In one embodiment, shown in FIG. 44, flat ribbons 81 and corrugated ribbons 82 alternate, with alternating corrugated ribbons (ignoring the flat ribbons) orthogonal to each other. In another embodiment, shown in FIG. 45, corrugated ribbons orthogonal to each other alternate, with no intervening flat ribbons. A portion 83 of the constituent ribbon material can be substantially porous, and a portion may be substantially solid (in these figures, only one illustrative strip is shown as porous, whereas a higher proportion of porous wall can be employed in many embodiments).

All of the elements herein described, and further elements, including, but not limited to, basic materials used; dimensions, orientation, patterning, and density of pores; ribbon thickness; ribbon coating, lamination, or treatment; connection or bonding methods; the degree of honeycomb expansion; strip patterning on ribbons; ribbon patterning; reinforcement; and the width of junction and free strips can be varied in multitudinous combinations to achieve desired macroscopic effects in honeycomb manufactured by expansion or pre-corrugation methods. Similar variations and combinations are possible in corresponding elements of honeycomb manufactured by integral methods, to create corresponding effects. Integral methods may also offer manufacture of honeycomb geometries not easily or practically attainable by expansion or corrugation methods (for example, some tessellations utilizing a wide range of rectangular shapes and sizes).

Hybrid honeycomb as, for example, illustrated in the descriptions above, is a basic building block material that can be used in a wide variety of applications, including ones where traditional honeycomb is presently used and ones where it is not. A few example constructions are described herein.

Figure 34:
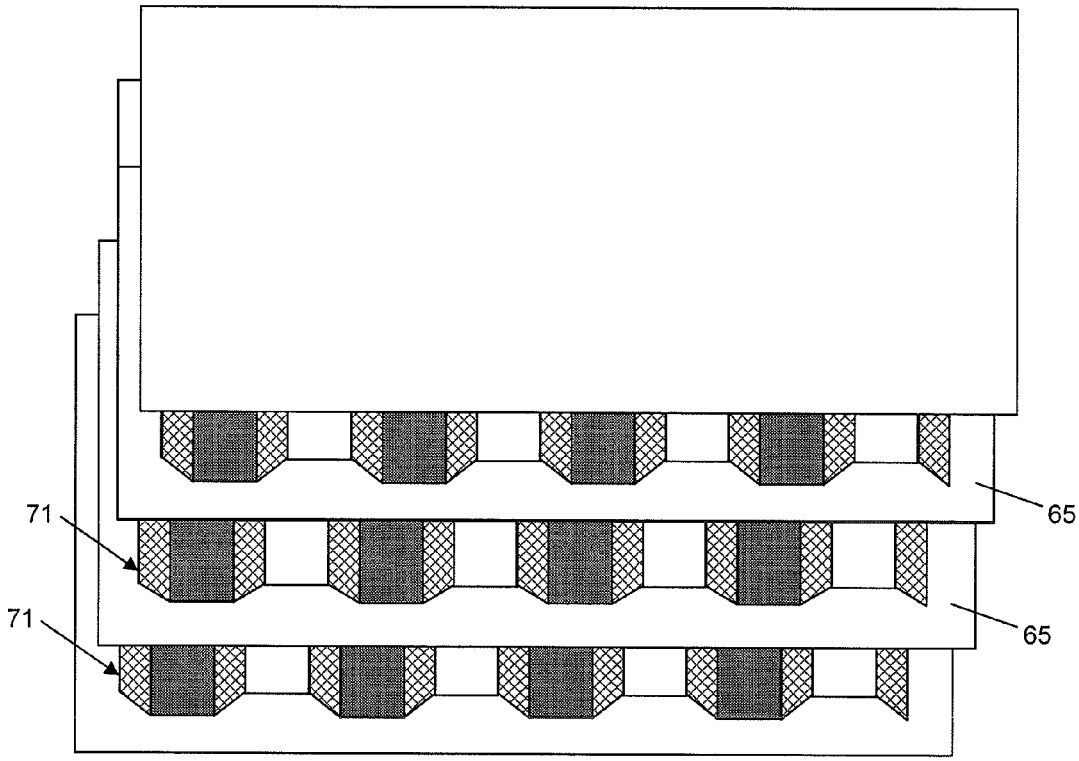
FIG. 34 shows a perspective view of hybrid honeycomb sheet stacked in interleaving layers with face members, in accordance with one embodiment of the invention.

Hybrid honeycomb can be attached using a variety of means to a face sheet on one (FIG. 33) or both open faces (thereby substantially sealing honeycomb cells on one or both sides), or honeycomb and sheet can be formed into a many-layered stack (FIG. 34). These assemblies can serve for impact energy absorption, structural support, or heat exchange. For heat exchange, they possess a distinct advantage over traditional honeycomb in that, using hybrid honeycomb, transverse fluid flow is possible in many designs, parallel to the face sheets. The structures will be lighter weight than analogous structures from traditional honeycomb and, while not as strong as traditional honeycomb, can absorb impact energy more smoothly.

Figure 35:
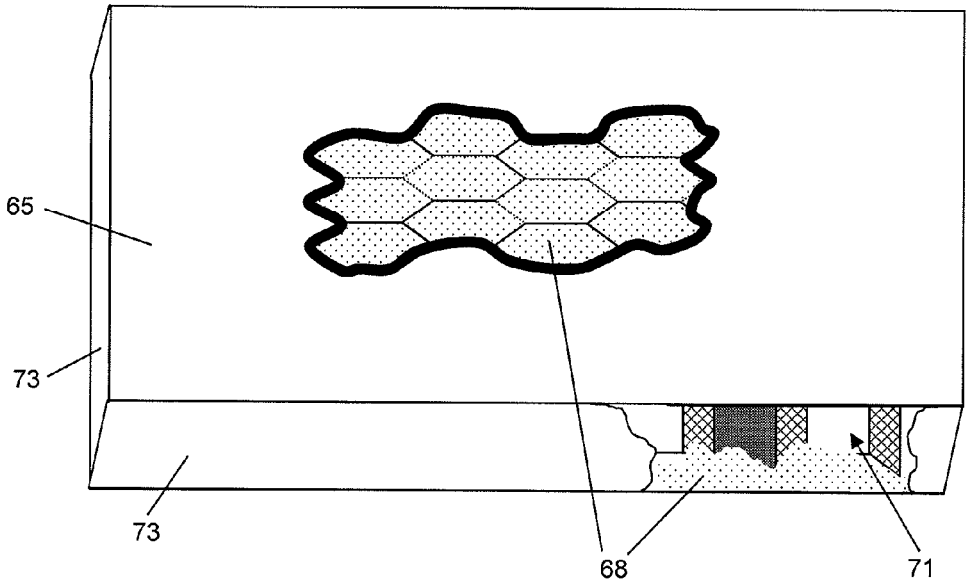
FIG. 35 shows a perspective view with cutaway of a hybrid honeycomb sandwich filled with phase change material, in accordance with one embodiment of the invention.

Many configurations of hybrid honeycomb can be easily impregnated with phase change material (PCM) even after one or more surfaces of the honeycomb have been sealed to an adjoining member. This can be accomplished even for many hybrid honeycombs with very small cell sizes or widths, because substantially porous walls prevent the entrapment of air, or other gases, within the honeycomb as it is filled with PCM. In contrast, air entrapment is an important problem for traditional honeycomb that is underexpanded or has a small cell size. Correspondingly, a sealed sandwich of hybrid honeycomb, faced with at least one thermally conductive wall, and impregnated with PCM 68, represents an important basic construction from hybrid honeycomb, and potential basis for high-performance heat sinks and exchangers. In one embodiment, illustrated by FIG. 35, with two cutaway views, side walls 73 are used with upper and lower face members 65 to create a total seal around the honeycomb block 71 and the PCM 68 which impregnates it.

Figure 41:
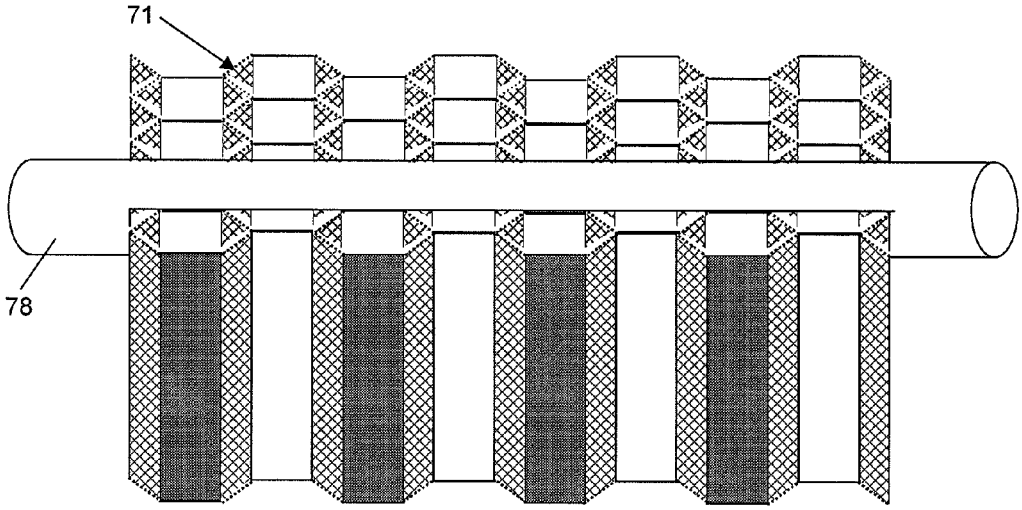
FIG. 41 shows a perspective view of a hybrid honeycomb fin-tube heat exchanger, in accordance with one embodiment of the invention.

Many different configurations of hybrid honeycomb enable compact design of fin-tube heat exchangers, as shown, for example, in FIG. 41. One method involves making one or more holes through, or one or more grooves in, a hybrid honeycomb block in a transverse plane, and insertion of fitted pipes or tubes 78 into the holes or grooves. The pipes or tubes can then be attached to the honeycomb using means providing strong thermal contact. Alternatively, pipes or tubes could simply be attached to the outside of a honeycomb block.

Figure 42:
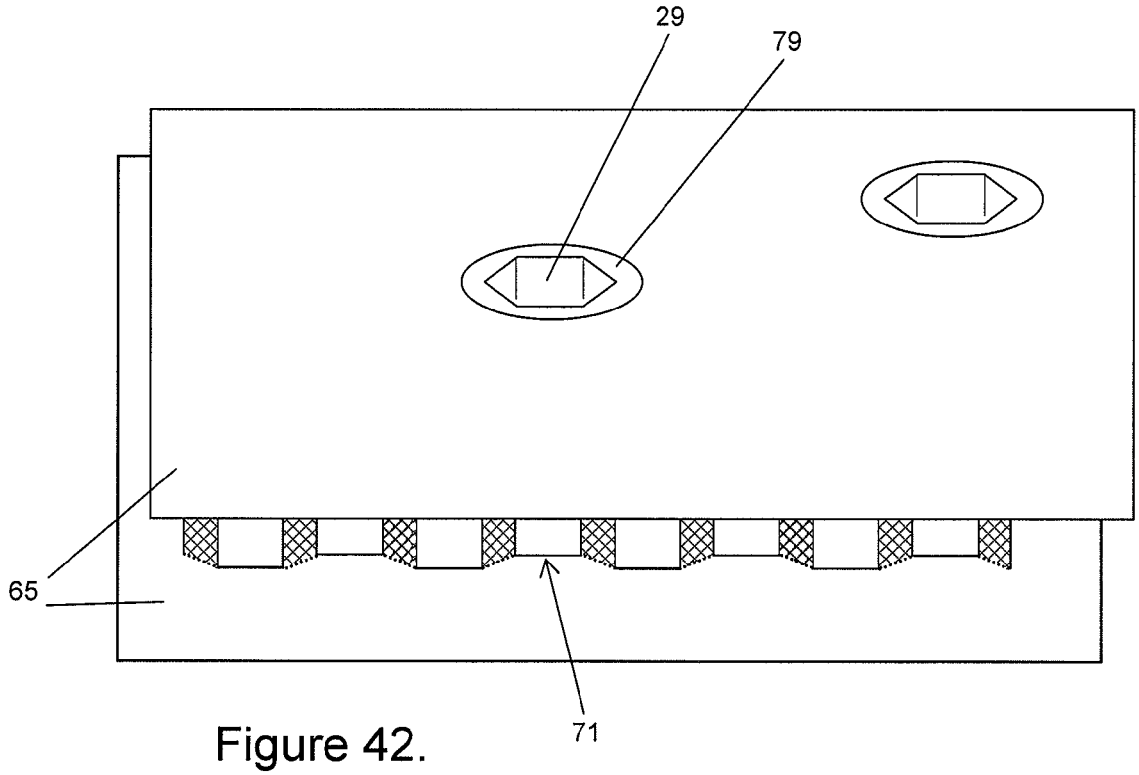
FIG. 42 shows a perspective view of a hybrid honeycomb cross-flow heat exchanger, in accordance with one embodiment of the invention.

Many different configurations of hybrid honeycomb enable compact design of cross-flow heat exchangers. In FIGS. 19 and 20, for example, one fluid could flow transversely, as depicted by arrows 57 and 58, respectively, whereas another fluid could flow through the cells sealed by substantially solid walls, namely cross-flow through-ways, along a perpendicular axis (in the direction perpendicular to the plane of the page of the figures). FIG. 42 shows an embodiment with two face members 65 sealing the open ends of a honeycomb block 71. Openings in the face members match solid-walled cross-flow through-way cells and are fitted with flanges 79 to make a seal between the through-way walls and face members. Alternatively, a plurality of cells could be individually sealed at both ends, but both ends of cross-flow through-way cells could be left unsealed. The same essential designs, incorporating perforated face members or individually sealed cells, could be used if the cross-flow units were not individual cells, but rather blocs of cells, each bloc bounded on its margins with substantially porous wall.

Many different configurations of hybrid honeycomb enable compact design of counter-flow heat exchangers. For example, many honeycombs described herein could be put to this use. Different fluids could flow transversely but in opposite directions (for example, the direction shown by arrow 59 in FIG. 21, and the opposite direction) in alternating channels or blocks of channels. Junctions at channel ends (honeycomb edges) can be configured to be wider than honeycomb interior junctions to facilitate joining and sealing with flanges and/or other plumbing components bringing fluid to and from the honeycomb.

Many different configurations of hybrid honeycomb enable simple construction of a filtration device. For example, a block of honeycomb can be sealingly framed by members across its two open faces and two other sidewall faces opposite from each other. Fluid flow would then be possible only through substantially porous cell walls in a transverse plane of the honeycomb block as channeled by the frame, assuming a hybrid honeycomb design allowing transverse flow in the appropriate direction. The hybrid honeycomb block and frame assembly would together form a filtration unit. Many modifications may be incorporated. For example, the members sealing the open-cell faces of the hybrid honeycomb could be removable, so that the filter could be cross-washed to remove filtrate trapped inside.

Figure 43:
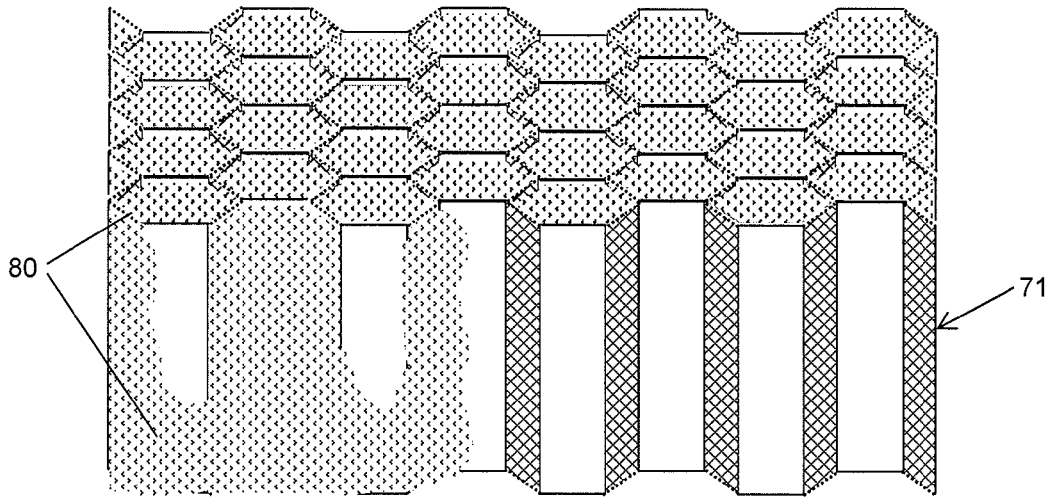
FIG. 43 shows a perspective view of a high performance compact heat exchanger with hybrid honeycomb and porous metallic filling, in accordance with one embodiment of the invention.

As shown in FIG. 43, hybrid honeycomb can be used in combination with a porous, thermally conductive matrix material 80 to create an exceptionally high-performance compact heat exchanger, wherein the porous matrix fills part or all of the cellular columns of the hybrid honeycomb. Candidate materials include, but are not limited to, sintered metal or other porous forms of metal or metal alloys, such as the reticulated metal foam manufactured by Energy Research and Generation, Inc. (ERG), of Oakland, Calif., under the trade name DUOCELL®, or such as the metal foams provided by Porvair Advanced Materials, Inc. (Porvair), of Hendersonville, N.C. In one possible means for creating this outcome, metallic hybrid honeycomb could be placed in a mold, and then a green mixture including but not necessarily limited to powdered metals for sintering could be added to fill most or all remaining void area in the mold, inside and around the honeycomb. Following a heating step and any other means required for manufacture of the final porous metal matrix, as, for example, in the manufacturing methods employed by ERG or Porvair, the final outcome would then be a porous metal interlaced with a hybrid honeycomb "skeleton" which together could provide an exceptionally high performance compact heat exchanger, since the skeleton would direct heat efficiently along cellular axes, while the porous metal would provide exceptionally high surface area of contact with fluids, and the hybrid nature of the honeycomb skeleton could allow for transverse fluid flow.

These application descriptions capture only the smallest fraction of potential uses for hybrid honeycomb in its various configurations. They are not meant to form a complete list or in any way limit the intended or suggested applications, but rather to serve as a small set of basic examples.

As suggested here, many applications of hybrid honeycomb will involve the bonding of honeycomb to one or more face members. In heat exchange applications, it will commonly be advantageous for one or more face members to make strong thermal contact with honeycomb. In cases where both the honeycomb and the member are metallic, high-heat methods such as soldering or brazing can provide some of the best thermal contact results. However, high temperature has the potential to destroy the junction bonds holding together honeycomb assembled from constituent ribbons. For the purposes of this invention, a honeycomb formed from ribbons and later modified by damage to or destruction of some or all ribbon junctions is still construed as honeycomb and covered by this invention.

Nevertheless, despite the potential destruction of many inter-ribbon bonds, means can be available to preserve the substantial shape of honeycomb intact during high-temperature bonding to a face member. In one such possible means, retaining walls or clamping members are placed around the outside of a honeycomb to be bonded, except not on the face to be bonded. Temperature is then raised and high-heat bonding proceeds between the face member to be bonded and the target honeycomb surface. After temperature has cooled sufficiently for the new bonds to be firmly established, the clamps and/or walls can be removed, or the honeycomb and member can be removed from any constraining chamber. The bond between the honeycomb and the face member may now be sufficient to retain the substantial shape of the original honeycomb, even if the ribbon junction bonds have been sundered.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A honeycomb structure comprising:

a plurality of contiguous hollow cells comprising a plurality of enclosing walls, wherein:

(i) at least a portion of at least one of the plurality if enclosing walls is porous;

(ii) at least one of the hollow cells comprising at least one nonporous enclosing wall;

(iii) at least one of the enclosing walls comprises a thickness of less than 0.01 inches; and (iv) diameter of the pores in the at least one porous wall is greater than 500 microns.

2. The honeycomb structure of claim 1, wherein the porous wall portion is adapted to allow a fluid to flow therethrough.

3. The honeycomb structure of claim 1, wherein at least one of the plurality of enclosing walls comprises a material selected from the group consisting of a metal, a metal alloy, a ceramic, a fiberglass material, a graphite material, a paper material, a plastic, and a thermoforming plastic.

4. The honeycomb structure of claim 3, wherein the metal is selected from the group consisting of aluminum, copper, stainless steel, titanium, brass, nickel, tin, zinc, iron, silver, gold, platinum, and combinations thereof.

5. The honeycomb structure of claim 1, wherein porosity of at least one of the porous wall portions is greater than about 25 percent.

6. The honeycomb structure of claim 2, wherein the plurality of enclosing walls are adapted to allow fluid flow between at least two of the plurality of contiguous hollow cells.

7. The honeycomb structure of claim 6, wherein the plurality of contiguous hollow cells form a plurality of substantially independent flow channels.

8. The honeycomb structure of claim 1, wherein at least one hollow cell comprises a plurality of nonporous walls to prevent fluid flow therethrough.

9. The honeycomb structure of claim 1, further comprising at least one cell group, wherein the cell group comprises a plurality of hollow cells, and wherein the cell group is surrounded by nonporous cell walls.

10. The honeycomb structure of claim 9, wherein at least one interior wall portion of the cell group is removed.

11. The honeycomb structure of claim 2, wherein a plurality of the nonporous enclosing walls are substantially parallel.

12. The honeycomb structure of claim 1, wherein porosity of at least one of the porous wall portions is greater than about 50 percent.

13. The honeycomb structure of claim 1, wherein the diameter of the pores in the at least one porous wall is greater than 1000 microns.

14. A honeycomb structure comprising:

a plurality of contiguous hollow cells comprising a plurality of enclosing walls, wherein;

(i) at least a portion of at least one of the plurality of enclosing walls is porous, (ii) at least one of the hollow cells comprises at least one nonporous enclosing wall;

(iii) porosity of at least one of the porous walls portions is greater than 25 percent; and (iv) diameter of the pores in the at least one porous walls is greater than 500 microns.

15. The honeycomb structure of claim 14, wherein the diameter of the pores in the at least one porous wall is greater than 1000 microns.

16. The honeycomb structure of claim 14, wherein porosity of at least one of the porous wall portions is greater than about 50 percent.

17. The honeycomb structure of claim 14, wherein at least one of the enclosing walls comprises a thickness of less than 0.01 inches and greater than 0.001 inches.

* * * * *